US007013970B2

(12) United States Patent
Collie et al.

(10) Patent No.: US 7,013,970 B2
(45) Date of Patent: Mar. 21, 2006

(54) CENTRAL CIRCULATION COMPLETION SYSTEM

(75) Inventors: Graeme John Collie, Dunfermline (GB); David Ramsay Hutchison, Dunfermline (GB); Richard Kent, Newburgh (GB)

(73) Assignee: FMC Technologies, Inc., Houston, TX (US)

( * ) Notice: Subject to any disclaimer, the term of this patent is extended or adjusted under 35 U.S.C. 154(b) by 78 days.

(21) Appl. No.: 10/276,135

(22) PCT Filed: Apr. 12, 2001

(86) PCT No.: PCT/GB01/01747

§ 371 (c)(1),
(2), (4) Date: Oct. 21, 2002

(87) PCT Pub. No.: WO01/81710

PCT Pub. Date: Nov. 1, 2001

(65) Prior Publication Data

US 2004/0074635 A1 Apr. 22, 2004

(30) Foreign Application Priority Data

Apr. 27, 2000 (GB) ..... 0010321

(51) Int. Cl.
*E21B 33/03* (2006.01)
*E21B 33/038* (2006.01)

(52) U.S. Cl. ..... 166/89.1; 166/75.13; 166/75.14; 166/88.1; 166/77.2; 166/344; 166/368

(58) Field of Classification Search ..... 166/379, 166/380, 344, 382, 384, 368, 77.2, 85.1, 166/86.1, 89.1, 75.14, 88.1, 97.5
See application file for complete search history.

(56) References Cited

U.S. PATENT DOCUMENTS

| | | | | |
|---|---|---|---|---|
| 3,067,819 | A | 12/1962 | Gore | |
| 4,651,831 | A * | 3/1987 | Baugh | 166/344 |
| 5,794,702 | A | 8/1998 | Nobileau | |
| 5,868,204 | A | 2/1999 | Pritchett et al. | |
| 6,453,944 | B1 * | 9/2002 | Bartlett | 137/601.01 |
| 6,612,368 | B1 * | 9/2003 | Kent et al. | 166/75.13 |

FOREIGN PATENT DOCUMENTS

| | | |
|---|---|---|
| GB | 1 205 303 | 9/1970 |
| GB | 1 403 957 | 8/1975 |
| GB | 2 311 312 A | 9/1997 |
| WO | WO99/18329 A1 | 4/1999 |
| WO | WO99/35368 A1 | 7/1999 |

OTHER PUBLICATIONS

Pointing, et al., "The Reeled Monodiameter Well," SPE 54508 (1999).
Abdrakhmanov, et al., "Isolation Profile Liner Helps Stabilize Problem Well Bores," Oil & Gas Journal, vol. 93, No. 37, pp. 50-52 (Sep. 11, 1995).

* cited by examiner

*Primary Examiner*—David Bagnell
*Assistant Examiner*—G. M. Collins
(74) *Attorney, Agent, or Firm*—Henry C. Query, Jr.

(57) ABSTRACT

A completion system comprises a christmas tree (10) mounted on a wellhead housing (11), a tubing hanger (12) landed in the tree or wellhead housing, the wellhead housing (11) being mounted on a casing string (100) and a tubing string (14) being suspended from the tubing hanger within the casing string; wherein, in use, the annulus defined between the tubing (14) and the casing (100) serves as a production bore. A second tubing string (98) is expanded into sealing engagement with the casing string (100) over at least a portion of their lengths. The annulus normally used to provide well service functions is thus eliminated. Well servicing is instead provided via the tubing string (14), which may be coiled tubing.

31 Claims, 22 Drawing Sheets

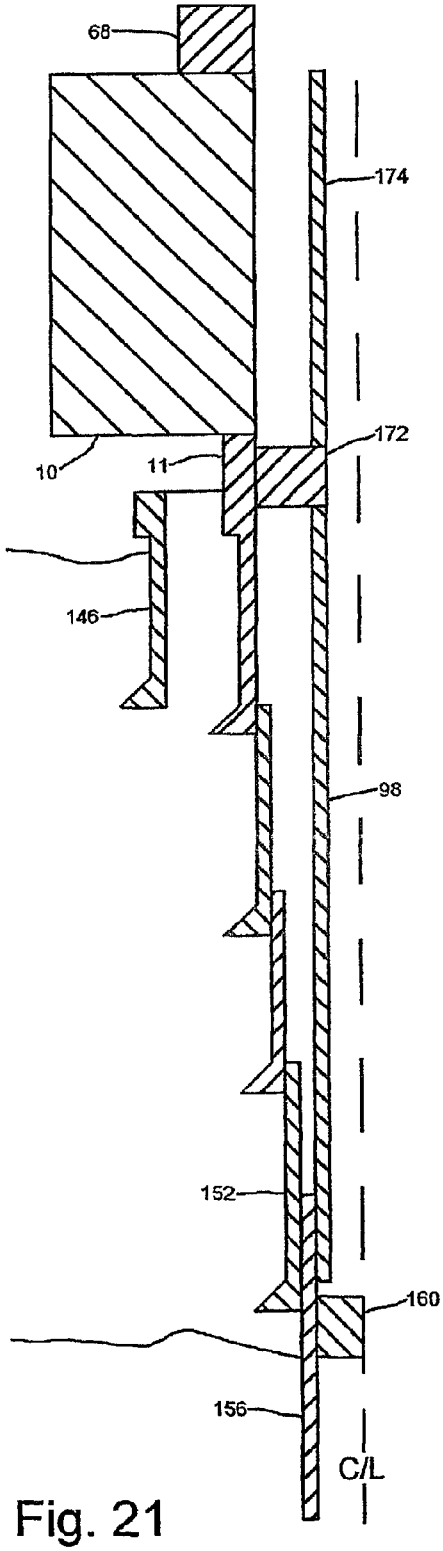
Fig. 21
Fig. 22
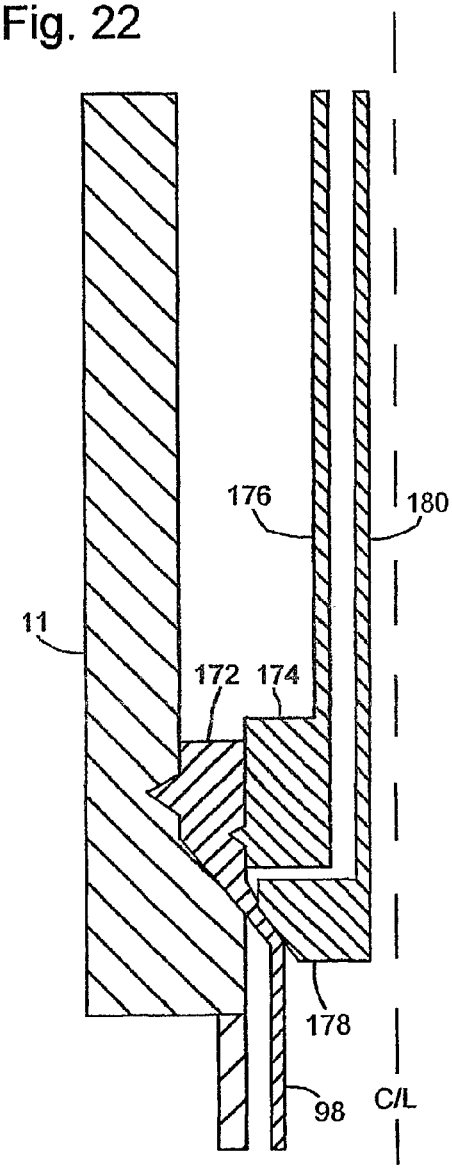

Fig. 23
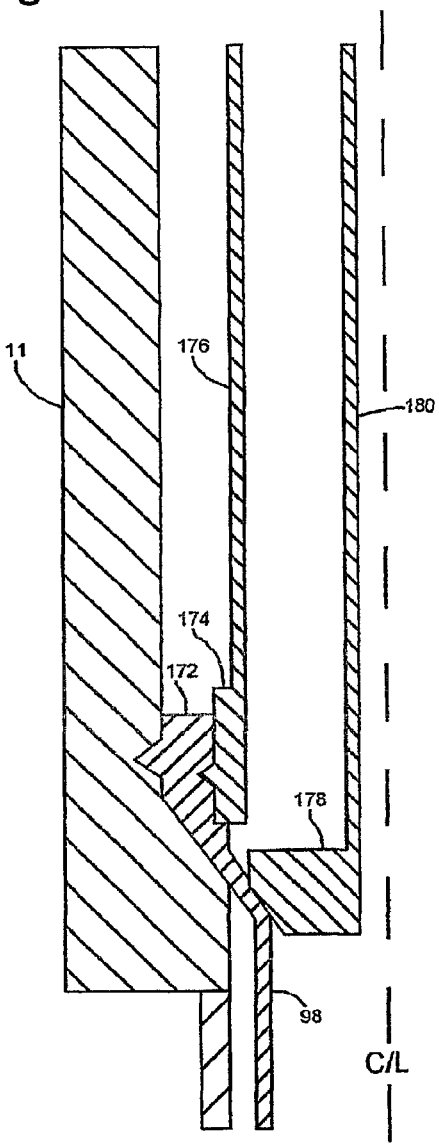
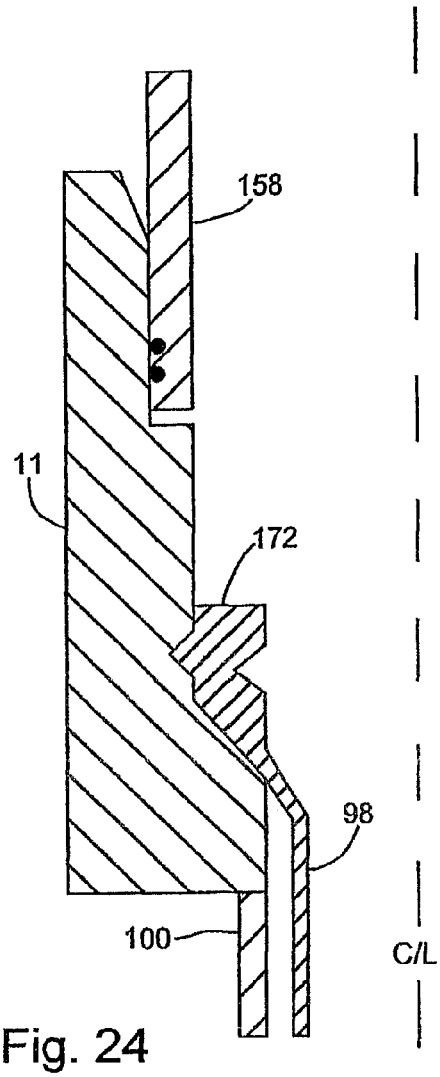
Fig. 24

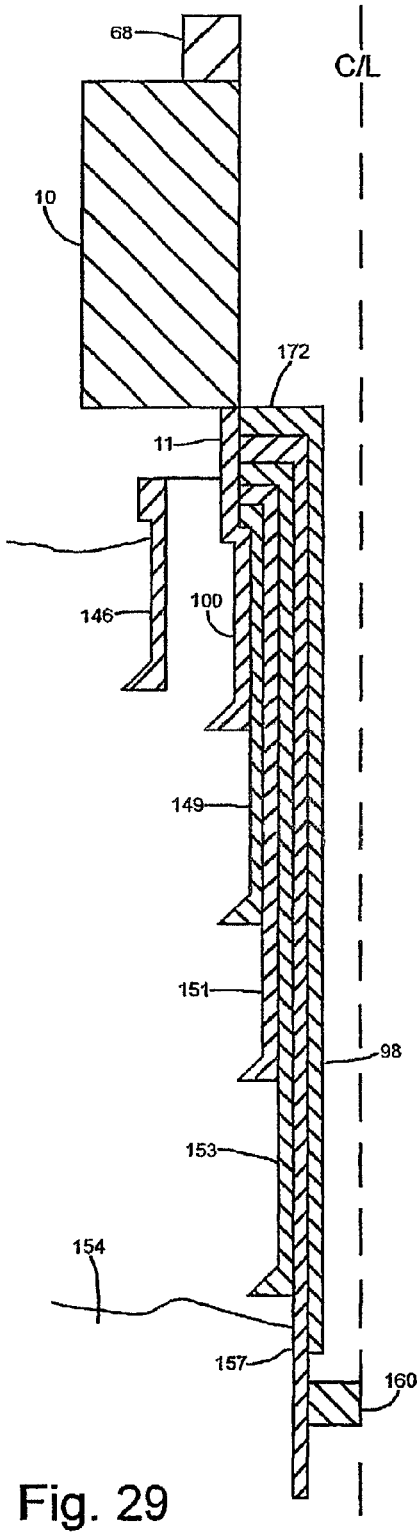
Fig. 29
Fig. 30
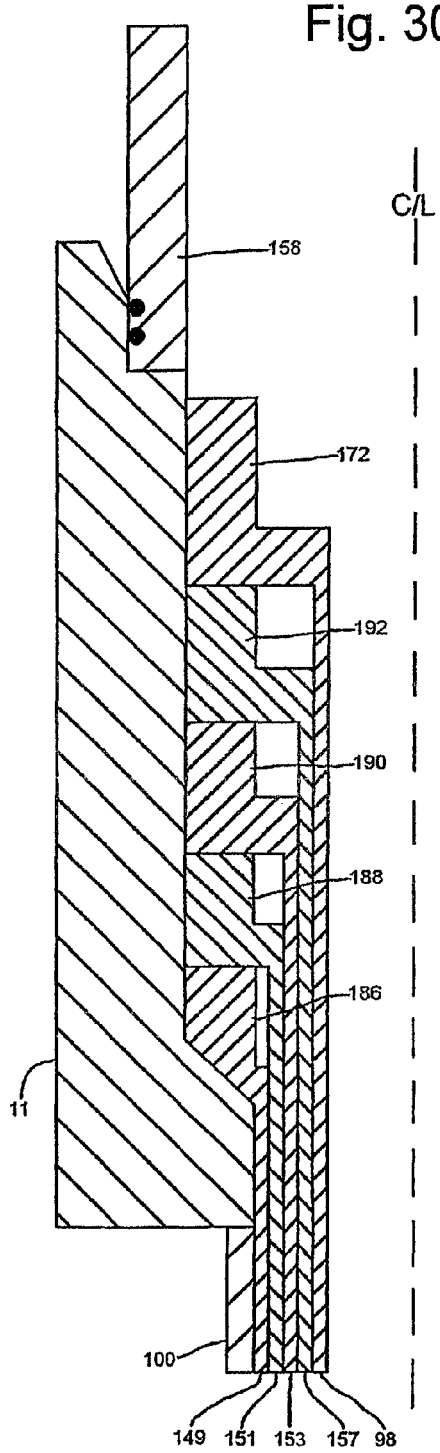

CENTRAL CIRCULATION COMPLETION SYSTEM

INVENTION BACKGROUND

Traditionally, a subsea christmas tree provides pressure control of a well completion system that comprises a centrally located well bore and a surrounding annulus conduit. The centrally located well bore is typically used for the extraction of reservoir hydrocarbons and is referred to as the production bore. The annulus conduit is typically used to service the well, for example allowing the circulation of fluids during well start up and shut down. During the production phase of the well, the annulus is often redundant and is monitored for pressure build up indicating a possible production tubing or packer leak from the production bore. Some wells employ the annulus for gas lift. Gas is pumped down the annulus and enters the production bore at specific locations thereby reducing the density and viscosity of the produced fluids. Electrical, optical and hydraulic service lines are also typically routed through the annulus for powering and control of downhole equipment such as valves and pumps, or for data transmission from downhole sensors. Chemical injection lines are likewise routed through the annulus.

Recent developments in expandable casing technology and reeled tubular technology dictate completion designs having decreased diameter well casing tubulars located external to the production tubing. The radial gaps between the tubulars are likewise reduced.

SUMMARY OF THE INVENTION

The present invention enables still further benefits to be gained from expandable casing technology. According to the invention, there is provided a completion system comprising a christmas tree mounted on a wellhead housing, a tubing hanger landed in the tree or wellhead housing, the wellhead housing being mounted on a casing string and a tubing string being suspended from the tubing hanger within the casing string; characterised in that, in use, the annulus defined between the tubing and the casing serves as a production bore and the tubing serves as a well service conduit; a second tubing string being expanded into sealing engagement with the casing string over at least a portion of their lengths. A second or outer tubing string surrounding that suspended from the tubing hanger may therefore be expanded to contact the production casing so that a seal is effected between these two tubulars, thereby eliminating the annulus conduit. The annulus conduit may only be absent at the base of the well in the case of a tapered well construction but uniform diameter, non-tapering wells are also possible in which the annulus is totally eliminated.

In this circumstance, it is no longer possible to circulate fluids in the well via the annulus and the central tubing string suspended from the tubing hanger performs the function that the annulus traditionally performs. The annulus conduit defined between the two tubing strings is now used for production. This has a significant impact on the configuration of the completion equipment, especially the tree. Further preferred features and advantages of the invention are in the dependent claims and the following description of preferred embodiments, made with reference to the drawings.

BRIEF DESCRIPTION OF THE DRAWINGS

FIG. 21 corresponds to FIG. 20 but diagrammatically indicates a liner and outer tubing run into the well;

FIGS. 22 and 23 show tubing expansion operations;

FIG. 24 is a diagram of the interface between the tree, wellhead housing and outer tubing of the completion system of FIG. 21;

FIG. 29 corresponds to FIG. 28 but diagrammatically indicates a liner, production casing and outer tubing run into the well, and FIG. 30 is a diagram of the interface between the tree, wellhead housing and outer tubing hanger of the completion system of FIG. 22.

DESCRIPTION OF THE PREFERRED EMBODIMENTS

The preferred completion system includes a subsea christmas tree configuration that will allow the installation of a centrally located service conduit. The preferred well, construction also comprises the following components that are typically used in completions and accordingly the subsea tree design provides the appropriate interfacing equipment:

SCSSV or functional equivalent

Downhole chemical injection

Gas lift mandrels

Downhole instrumentation, e.g. pressure and temperature gauges

The central service conduit provided by a central coiled tubing string is preferably replaceable with minimum impact on the installed second or outer production tubing and subsea christmas tree equipment. The outer tubing string is terminated at the wellhead housing (either with or without a tubing hanger) and the tree seals to the wellhead housing with a seal stab.

Figure 1:
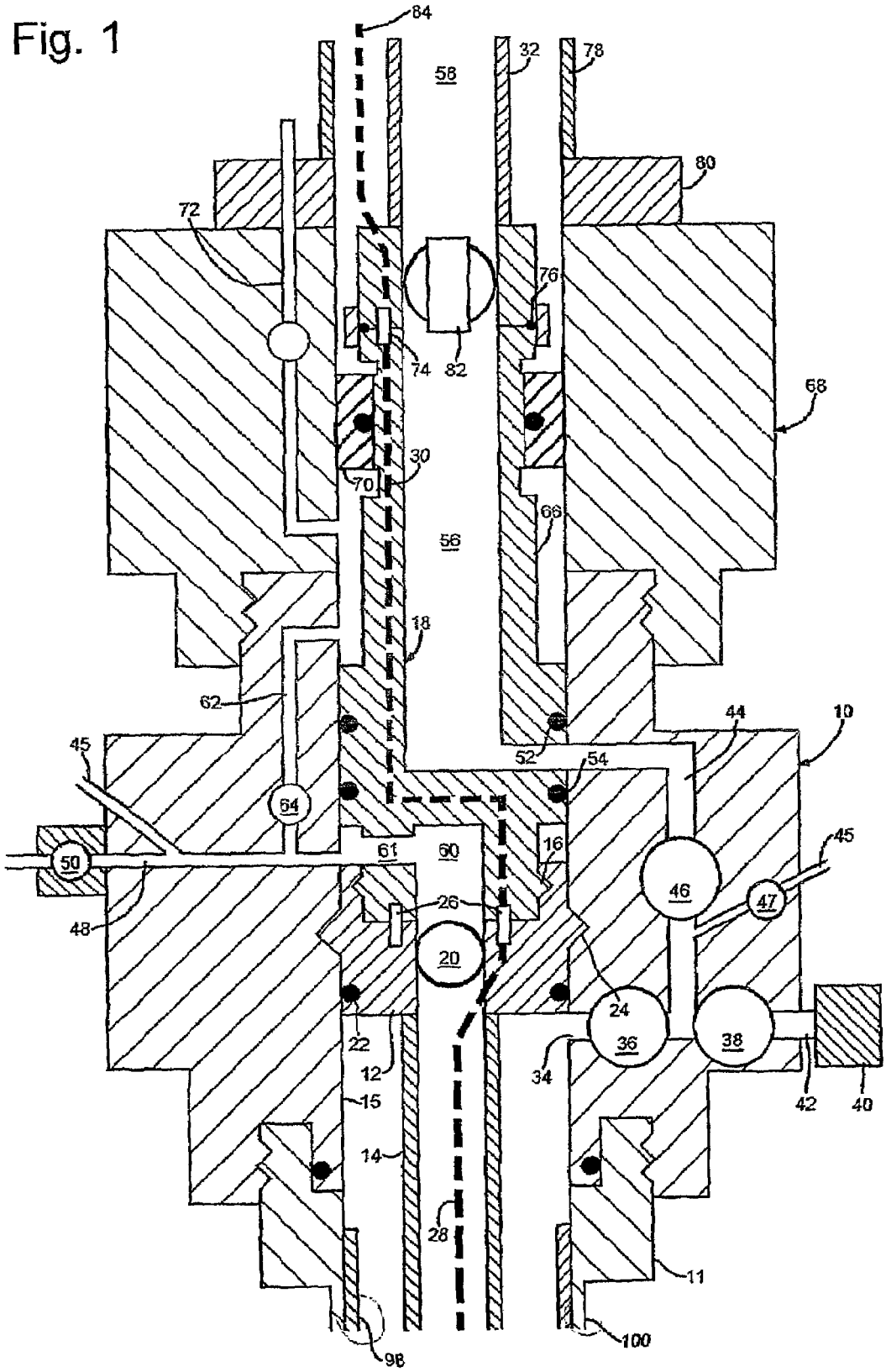
FIG. 1 is a diagrammatic representation of a first completion system embodying the invention, shown during installation/testing.

Referring to FIG. 1, coiled tubing 14 is suspended from a coiled tubing hanger 12 in a horizontal christmas tree 10. The tree 10 is locked and sealed to a wellhead housing 11. No SCSSV is included in the system. For installation, the coiled tubing hanger 12 has a lock profile 16 by which it is attached to an installation test tool 18. A central circulation/service valve 20 is situated in the coiled tubing hanger 12 for controlling fluid flows from/to the coiled tubing 14. The coiled tubing hanger 12 is landed in a vertically extending through bore 15 in the tree 10. The tubing hanger 12 is sealed and locked to the tree as schematically indicated, by annular seal 22 and lock profile 24. Remote wet mate couplers 26 allow downhole service and control lines 28 to be connected to corresponding lines 30 in the installation test tool 18 and its installation string 32. The outside diameters of the coiled tubing hanger 12, installation test tool 18 and installation string 32 are compatible with the drift of a monobore completions riser which has, for example, a bore diameter of 17.1 mm (6.75").

A production conduit 34 intersects with the through bore 15 below the tubing hanger seal 22. A production master valve 36 and a production wing valve 38 are provided in the production conduit 34. A pressure cap 40 is optionally installed on a wing outlet 42 of the tree 10 at the stage of installation and subsequent flow test. For flow testing, a production bypass conduit 44 containing a valve 46 extends between the production conduit 34 to the through bore 15 above the tubing hanger seal 22. A service/circulation conduit 48 intersects with the through bore 15 above the tubing hanger seal 22. The conduit 48 contains a valve 50 of equivalent function to the annulus wing valve of a "standard" horizontal tree. However, rather than communicating with a production tubing/production casing annulus as is conventional, the service/circulation conduit 48 is connected to the upper end of the coiled tubing 14. A crossover conduit 45 containing a crossover valve 47 connects the bypass conduit 44 (and/or the production conduit 34 between the valves 36, 38) to the circulation/service conduit 48.

The installation test tool 18 is connected between the coiled tubing hanger 12 and the installation string 32. Upper and lower seals 52, 54 seal a lower end of the installation test tool 18 within the tree through bore 15. A conduit 56 in the installation test tool 18 has a side outlet positioned between the seals 52, 54 for communication with the production bypass conduit 44, and an upper end in communication with a riser conduit 58 in the installation string 32. During flow testing, production fluid may therefore be led to the surface rig or vessel through the installation test tool interior and the riser conduit 58.

The lower end of the installation test tool 18 also has a central bore 60 in communication with the coiled tubing interior via the central circulation/service valve 20. A side outlet 61 leads from the bore 60 to the circulation/service conduit 48. A workover conduit 62 containing a workover valve 64 extends from the circulation/service conduit 48 to the tree through bore 15 at a point above the installation test tool upper seal 52. The other end of the installation test tool 18 comprises an upwardly extending spool 66 through which runs the conduit 56. A BOP 68 is attached to the upper end of the tree 10. Pipe rams 70 in the BOP 68 can be closed and sealed about the installation test tool spool 66, thereby sealingly connecting the workover conduit 62 to a choke/kill line 72 of the BOP.

The installation test tool also allows controls to be hooked up to the down-hole lines 28 and for operation of the circulation/service valve 20 in the coiled tubing hanger 12. Besides the remote subsea mateable couplers 26 to the top of the coiled tubing hanger 12, the installation test tool 18 also includes further remote subsea mateable couplers 74 to the base of the installation string 32.

The installation string 32 is latched and sealed to the top of the installation test tool 18 by a remotely operable connector 76 providing emergency disconnect capability. A monobore completions riser 78 is connected to the upper end of the BOP 68 by a lower marine riser package 80 which also provides for emergency disconnection. When disconnected, any fluids present in the riser conduit 58 are retained by a valve 82. The couplers 74 connect the control lines 30 in the installation test tool 18 to a controls umbilical 84 attached to the installation string 32.

Figure 2:
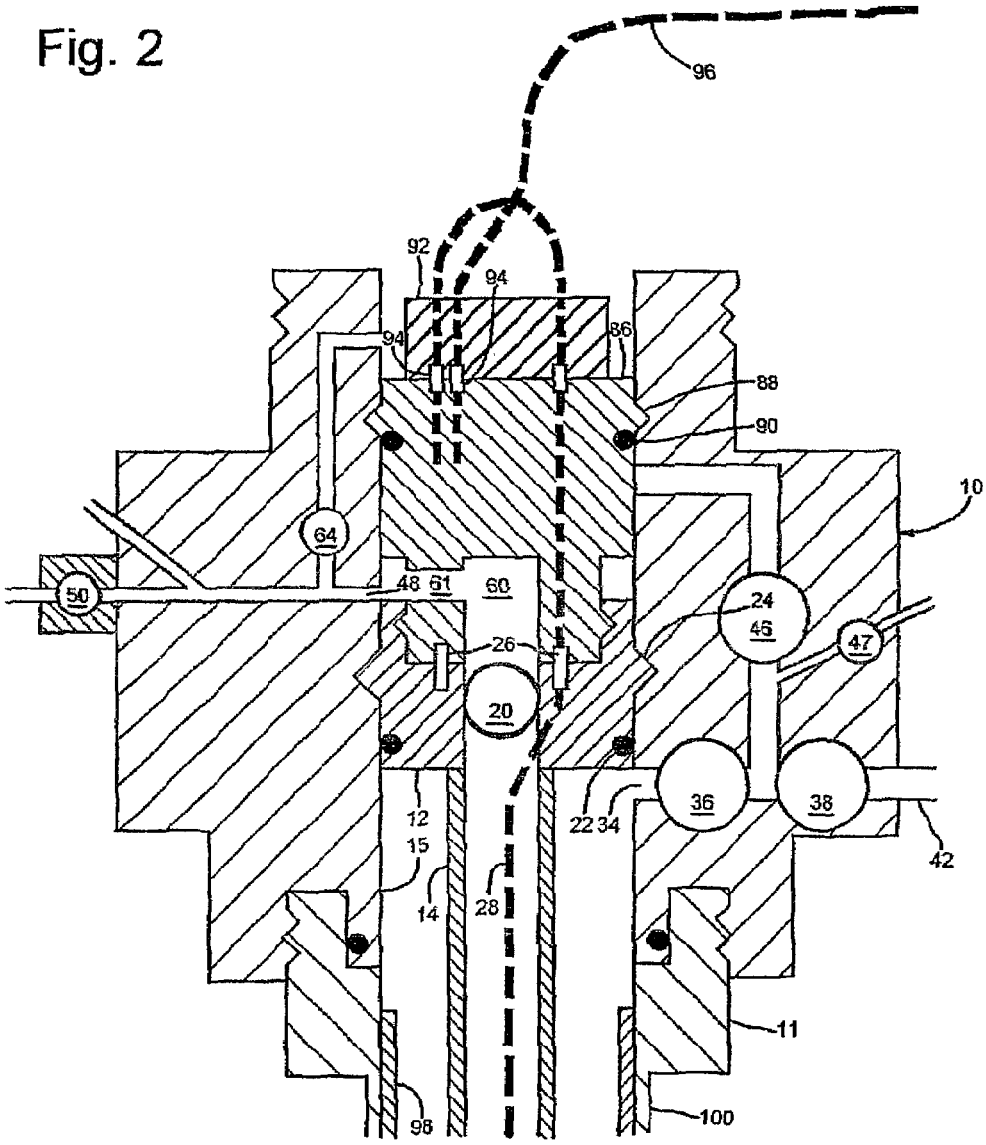
FIG. 2 corresponds to FIG. 1 but shows the system in production mode.

FIG. 2 shows the tree in production mode. An internal tree cap 86 is installed through the BOP 68 in place of the installation test tool 18 and installation string 32. The BOP 68 is then removed. The tree cap 86 locks and seals to the tree bore 15 above the production conduit 34 intersection as schematically illustrated by locking profile 88 and seal 90. Remote subsea mateable couplers 26 are again provided for hook up of control lines to the central circulation/service valve 20 in the coiled tubing hanger 12 and to the downhole lines 28. A controls cap 92 with remote wet mate couplers 94 connects the control lines to a jumper 96. The central bore 60 and side outlet of the installation test tool are reproduced in the tree cap 86 to provide fluid communication between the coiled tubing interior and the circulation/service conduit 48.

The completion system illustrated in FIGS. 1 and 2 satisfies accepted double barrier pressure containment philosophy/industry practice. It provides communication to multiple down-hole electrical and hydraulic service lines, either via a controls umbilical run with the installation string, or via a controls cap and jumper in production mode. A central coiled tubing string 14 is suspended in the well, to provide a means of well circulation for well startup and well kill. It also provides a means for readily installing or removing (eg for servicing and repair) downhole equipment such as valves, pumps, gas lift and chemical injection mandrels and downhole instrumentation. This can be installed/replaced without disturbing the outer production tubing and tree.

The central coiled tubing string 14 is suspended within an outer tubing string 98 which is expanded into sealing contact with surrounding production casing 100 and the wellhead housing 11. The need for tubing hangers and packers may thus be eliminated. If a tubing hanger is used to suspend the outer tubing string 98 which has its lower end expanded into contact with the production casing, the outer tubing hanger is landed in the wellhead 11 because the outer tubing 98 is permanently attached to the other well tubulars and cannot be retrieved. Landing the outer tubing hanger in the tree 10 would therefore prevent (or at least make difficult) the recovery of the tree. If tubing corrosion occurs, a new (thin wall) liner tubing can be expanded into place inside the old outer tubing.

The use of expandable well tubulars also results in a more gradually tapering, or even uniform diameter, well. Thus the upper tubulars and completion equipment are of reduced size and weight compared to conventional wells of equivalent depth, giving materials savings and reduced operational costs. The marine riser system/BOP stack used at installation only needs a bore similar to a completions riser. Therefore it is very similar to a lightweight intervention system. Faster drill penetration rates can be achieved and the use of lower cost vessels with lower lift capacity is made possible.

Flow tests may be conducted via the installation string and workover access is provided via the coiled tubing string. The tree has a similar cost and complexity to known horizontal trees. No subsea test tree is needed during installation and workover. There is potential to adapt the system for a dual zone completion, for the use of ESP's, or for downhole separation. The effective production tubing size can be reduced as the well matures, by increasing the diameter of the coiled tubing, or a velocity string can be fitted. The completion system offers improved control of well circulation via the subsea tree for well kill or gas lift applications.

Figure 3:
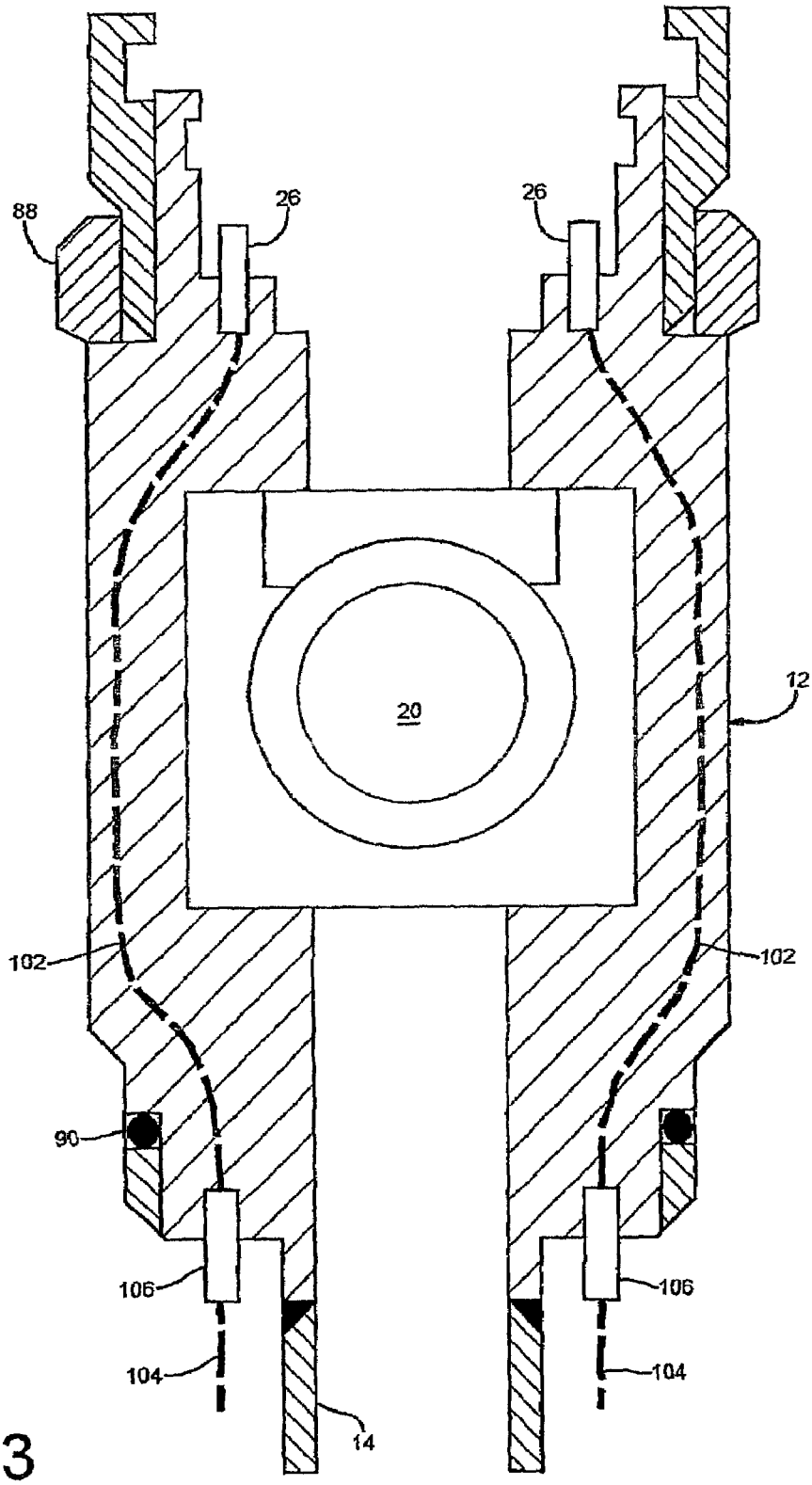
FIG. 3 diagrammatically represents a tubing hanger such as may be used in the system of FIG. 1.
Figure 4:
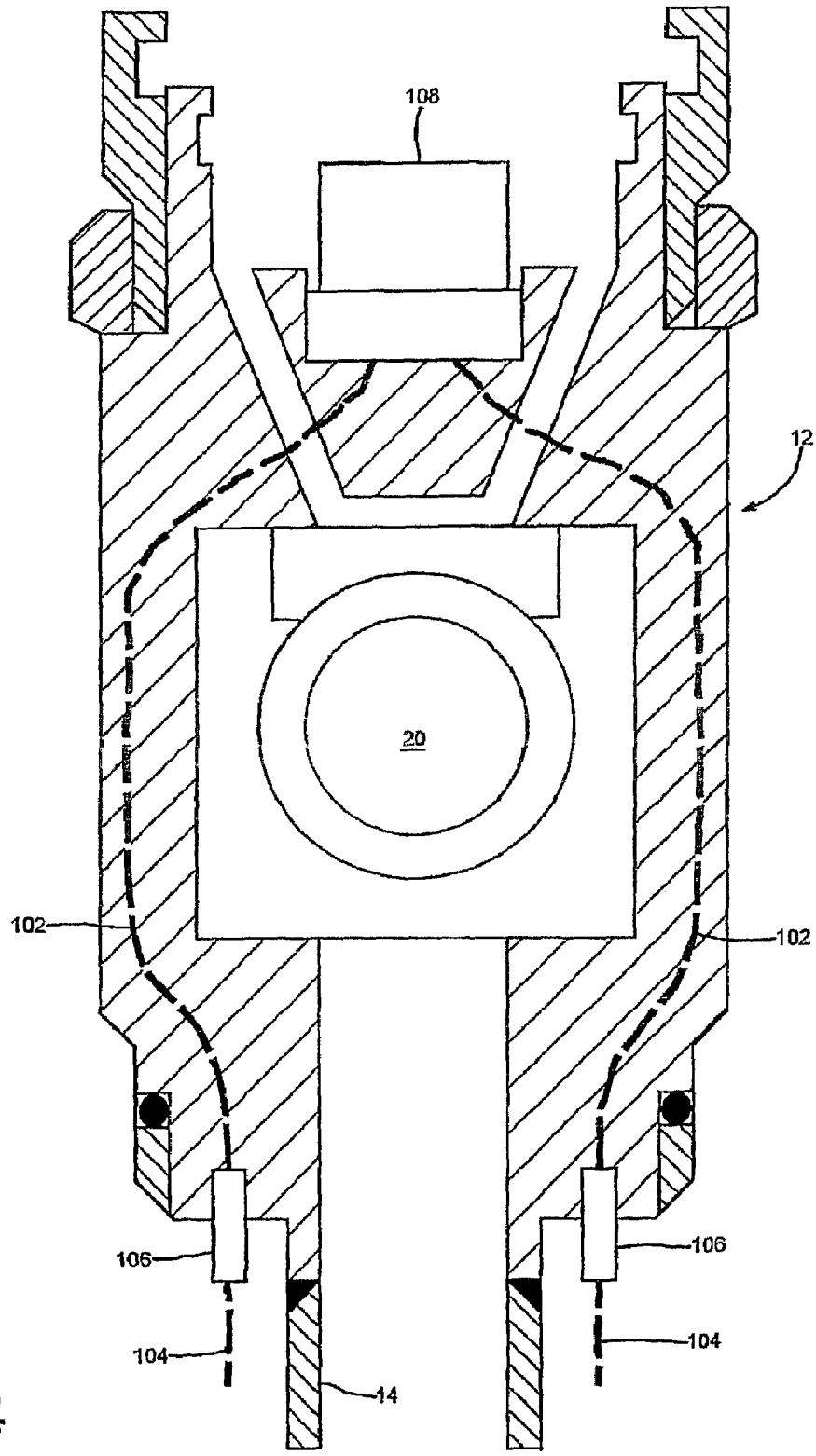
FIGS. 4 and 5 show an alternative tubing hangers.
Figure 5:
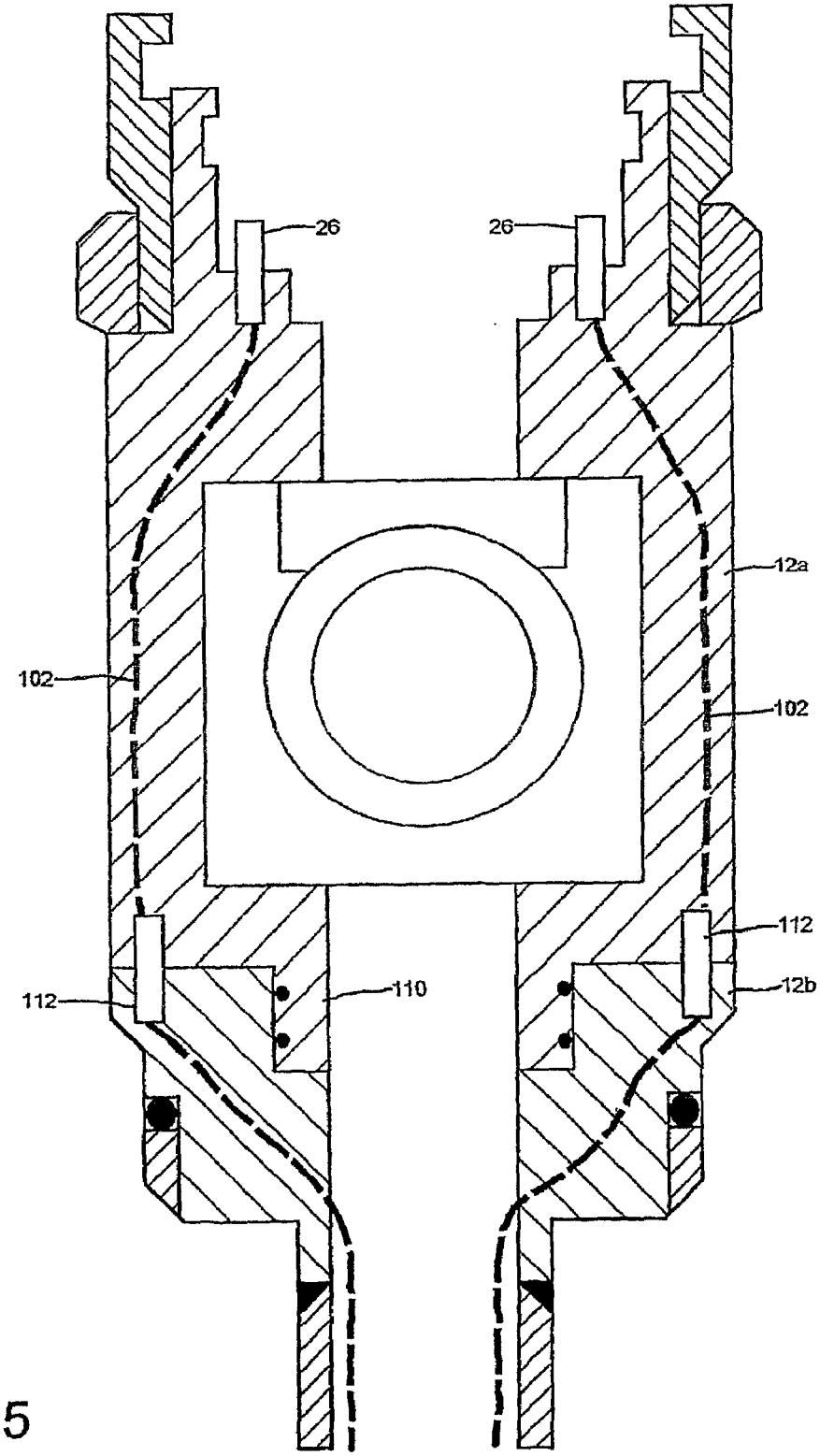

FIGS. 3–5 illustrate various alternatives for the coiled tubing hanger configuration. FIG. 3 shows a single body coiled tubing hanger 12 with an integral ball valve 20 and hydraulic actuator. Down hole control lines 102 pass through the hanger body and are connected to control lines 104 external to the coiled tubing 14 via couplers 106. The down hole controls lines are therefore exposed to produced fluids and mechanical damage during the trip in the hole. The remote mateable couplers 26 must be made very small.

FIG. 4 shows a single, multi-pin, self orienting subsea mateable connector 108 instead of the multiple connectors 26. This system is particularly suitable if the down hole lines 104 are all of the same type, e.g electrical, optical or hydraulic. It is less suitable if there is a combination of different line types.

FIG. 5 shows a split hanger arrangement in which the coiled tubing hanger comprises two separable parts 12*a*, 12*b*, joined by a seal stab 110. The lower part 12*b* is prefabricated as part of the coiled tubing string and the service line couplers 112 are factory tested. The lower part 12*b* is assembled to the upper part 12*a* at the drill floor. This design may have multiple single-pin subsea mateable couplers as shown, or a multi-pin connector similar to 108, FIG. 4.

Figure 6:
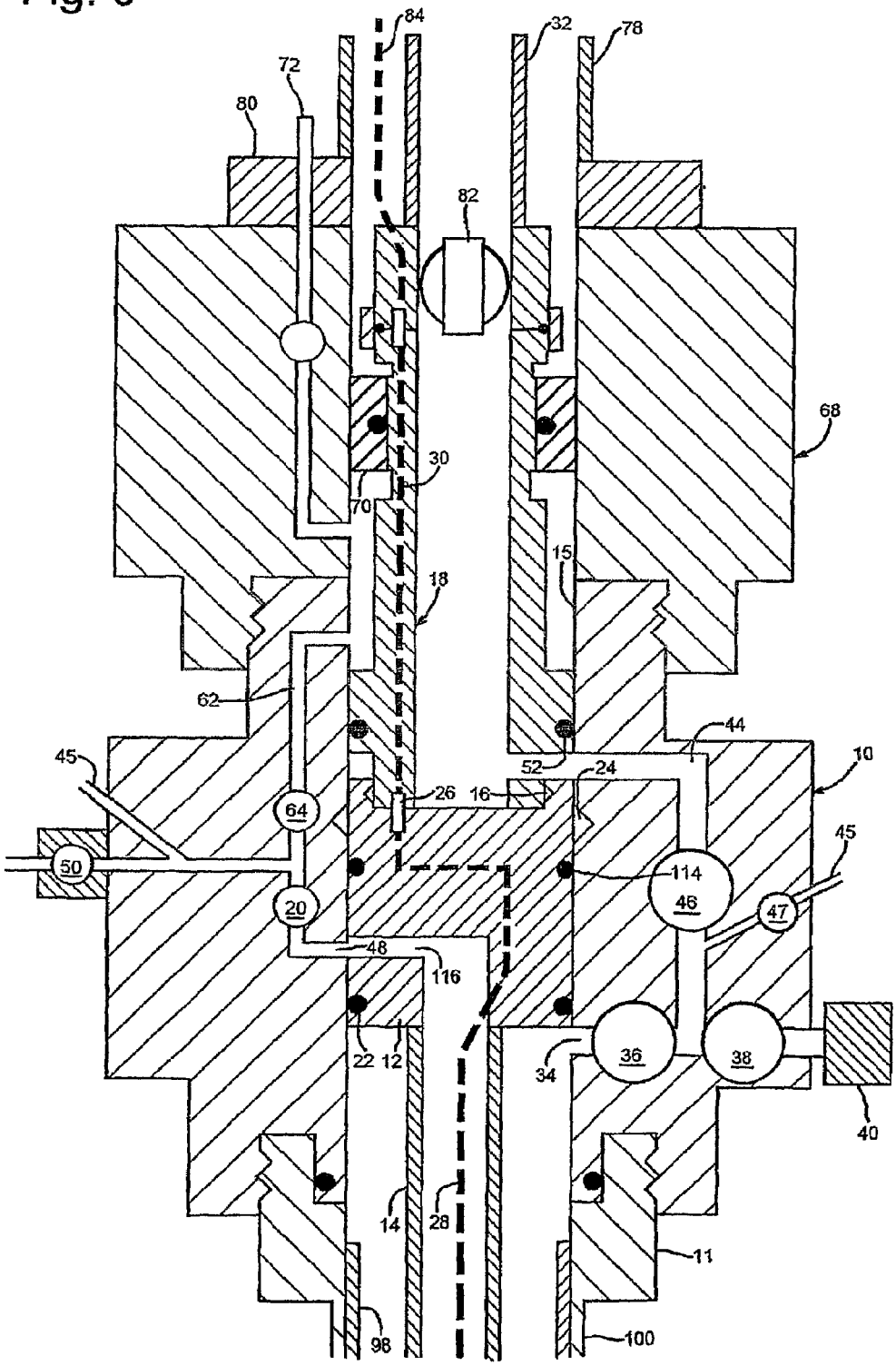
FIGS. 6, 8, 10 and 12 are diagrams of second, third, fourth and fifth embodiments of the completion system respectively, all shown during installation/testing.

FIG. 6 shows a modification of the system of FIG. 1, in which the coiled tubing hanger 12 has a blind top, i.e. no vertical through bore is provided. Comparing with the FIG. 1 embodiment, in FIG. 6 the central circulation/service valve 20 has been moved from the coiled tubing hanger 12 to the circulation/service conduit 48 in the tree 10. The workover conduit 62 still joins the central circulation/service conduit 48 between the valve 20 and the wing valve 50. The lower seal 54 on the installation test tool 18 has been eliminated and an additional upper seal 114 provided on the coiled tubing hanger 12. A side outlet 116 in the tubing hanger 12, analogous to the installation test tool side outlet 61 in FIG. 1, communicates with the circulation/service conduit 48, between the tubing hanger upper and lower seals 114, 22. In other respects, the FIG. 6 arrangement is structurally and functionally similar to that of FIG. 1.

Figure 7:
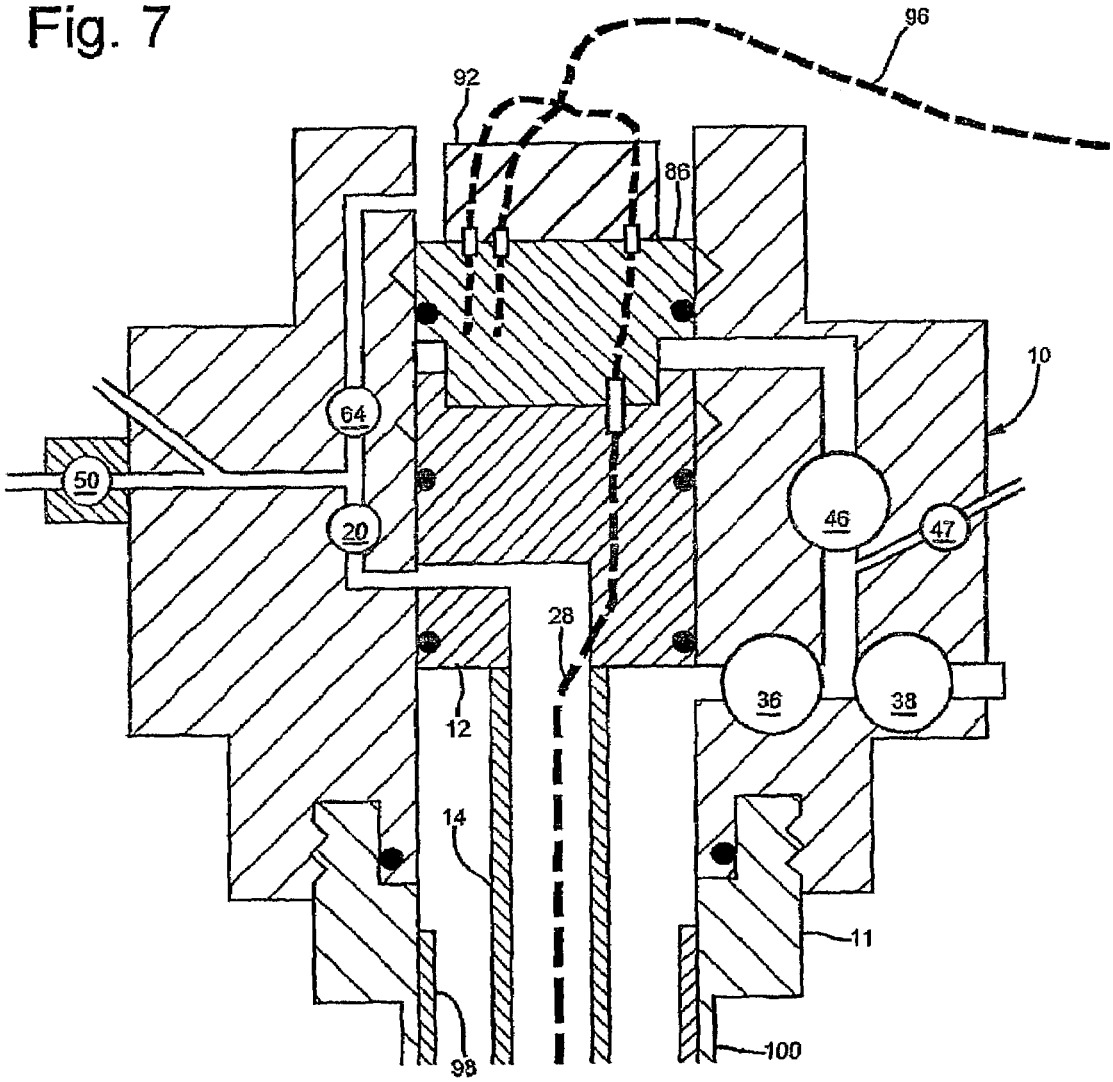
FIGS. 7, 9, 11 and 13 correspond to FIGS. 6, 8, 10 and 12 respectively, but show the system in production mode.

FIG. 7 shows the system of FIG. 6 in production mode. It is analogous to FIG. 2, but having a simplified internal tree cap 86, as the bore 60 and side outlet 61 are eliminated. A controls cap 92 and a controls jumper 96 are again provided.

Figure 8:
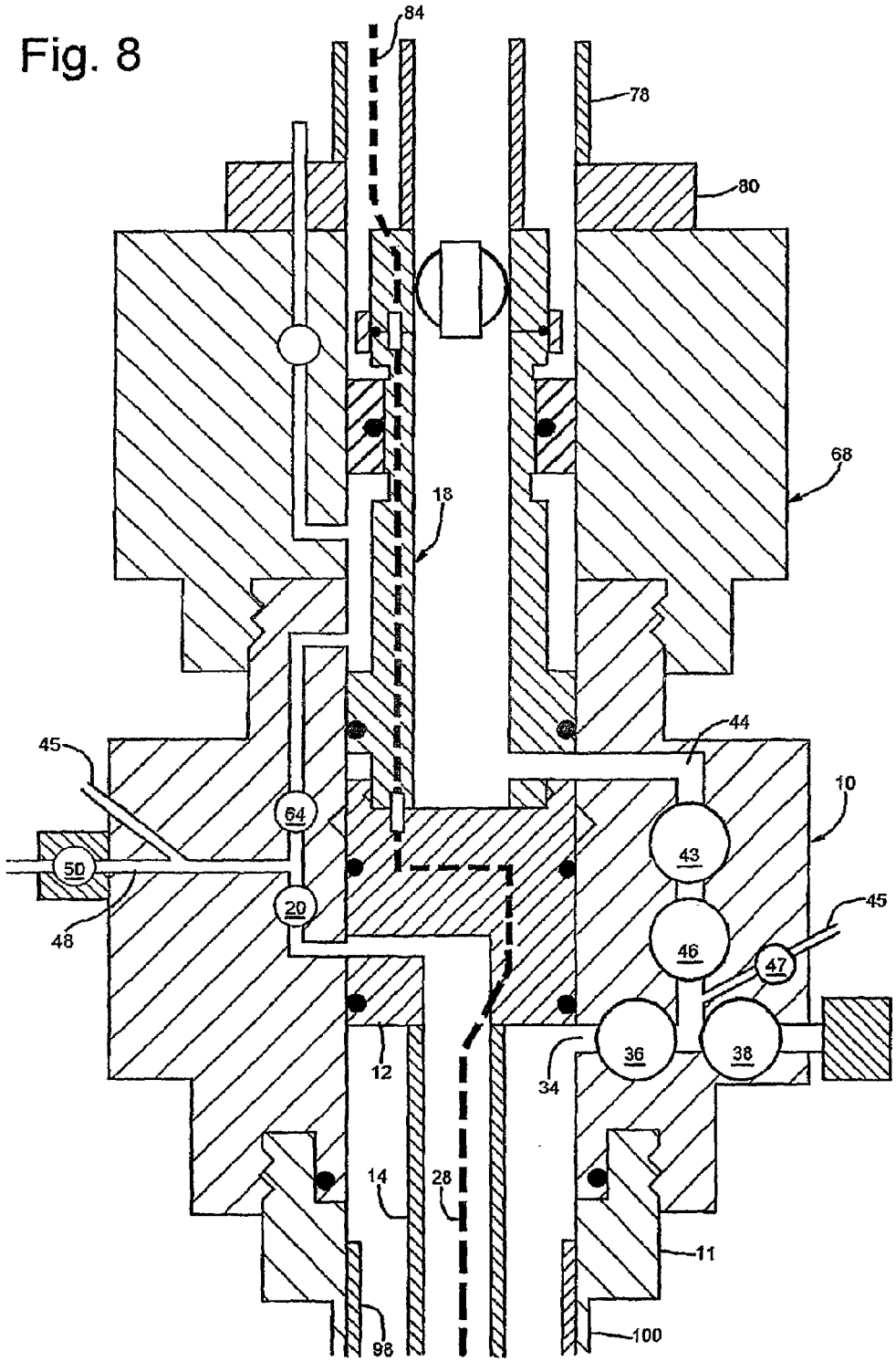

FIG. 8 shows a third embodiment, similar to FIG. 6, except that a second production bypass valve 43 is provided in the production bypass conduit 44, in series with the valve 46. This enables the tree cap 86 to be eliminated in production mode (FIG. 9), as the valve 43 can serve as a second pressure barrier in series with the valve 46, when the production master valve 36 is open. If desired, a secondary lockdown device 118 can be provided for the coiled tubing hanger 12 in production mode. The controls cap 92 and couplers 94 interface directly with the coiled tubing hanger 12. The embodiment of FIGS. 1 and 2 may be modified in similar manner.

Figure 10:
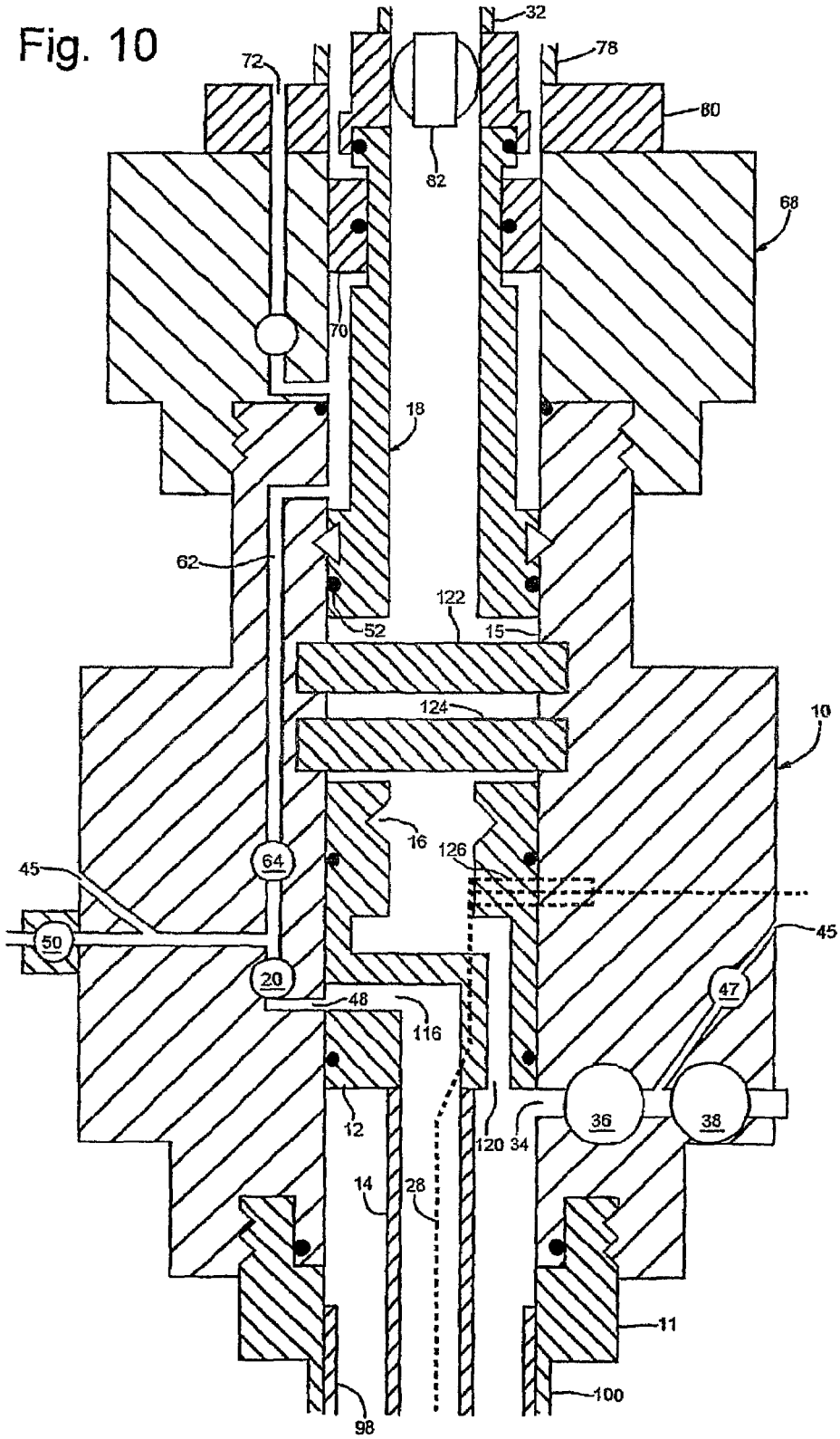

FIG. 10 shows a further modification of the FIG. 6 embodiment. The production bypass conduit 44 and bypass valve 46 have been eliminated, likewise the side outlet in the installation test tool 18 below the seal 52. Instead, the coiled tubing hanger 12 is provided with flow by slots or a flow by conduit 120 extending from the annulus defined between the tubing strings 14, 98 below the tubing hanger 12, to the tree through bore 15 above the tubing hanger 12. The installation test tool 18 no longer interfaces with the tubing hanger lock profile 16. Instead, a separate tubing hanger running tool (not shown) is used to install the tubing hanger 12. Upper and lower swab valves 122, 124 (e.g. large diameter gate valves) are provided in the tree through bore 15 between the installation test tool 18 and the coiled tubing hanger 12. In production mode (FIG. 11) these swab valves are closed to provide a double pressure barrier, so that no tree cap is needed. The workover conduit 62 extends from the circulation/service conduit, to the through bore 15 above the installation test tool lower seal 52, for fluid communication with BOP choke/kill lines 72, as previously described. Hook up to the downhole service lines 28 is by means of horizontal penetrators in the tree 10, which interface with the coiled tubing hanger 12. The coiled tubing hanger 12 is effectively pressure balanced and theoretically needs no lock down. The lower end of the coiled tubing string 14 is not fixed so thermal expansion does not provide an upthrust. Notional lock down is provided by the horizontal penetrators 126 from the tree 10.

Figure 12:
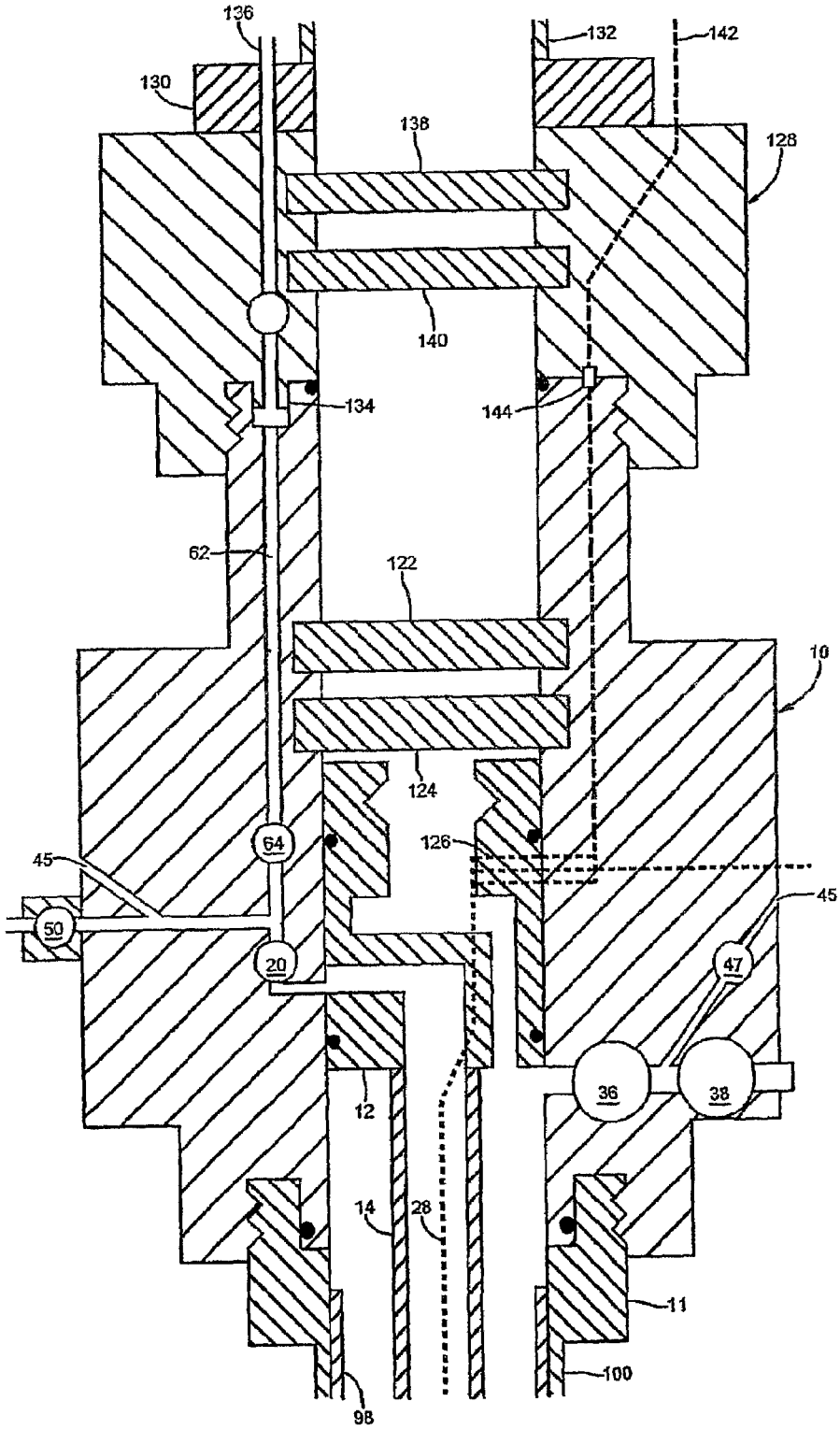
Figure 13:
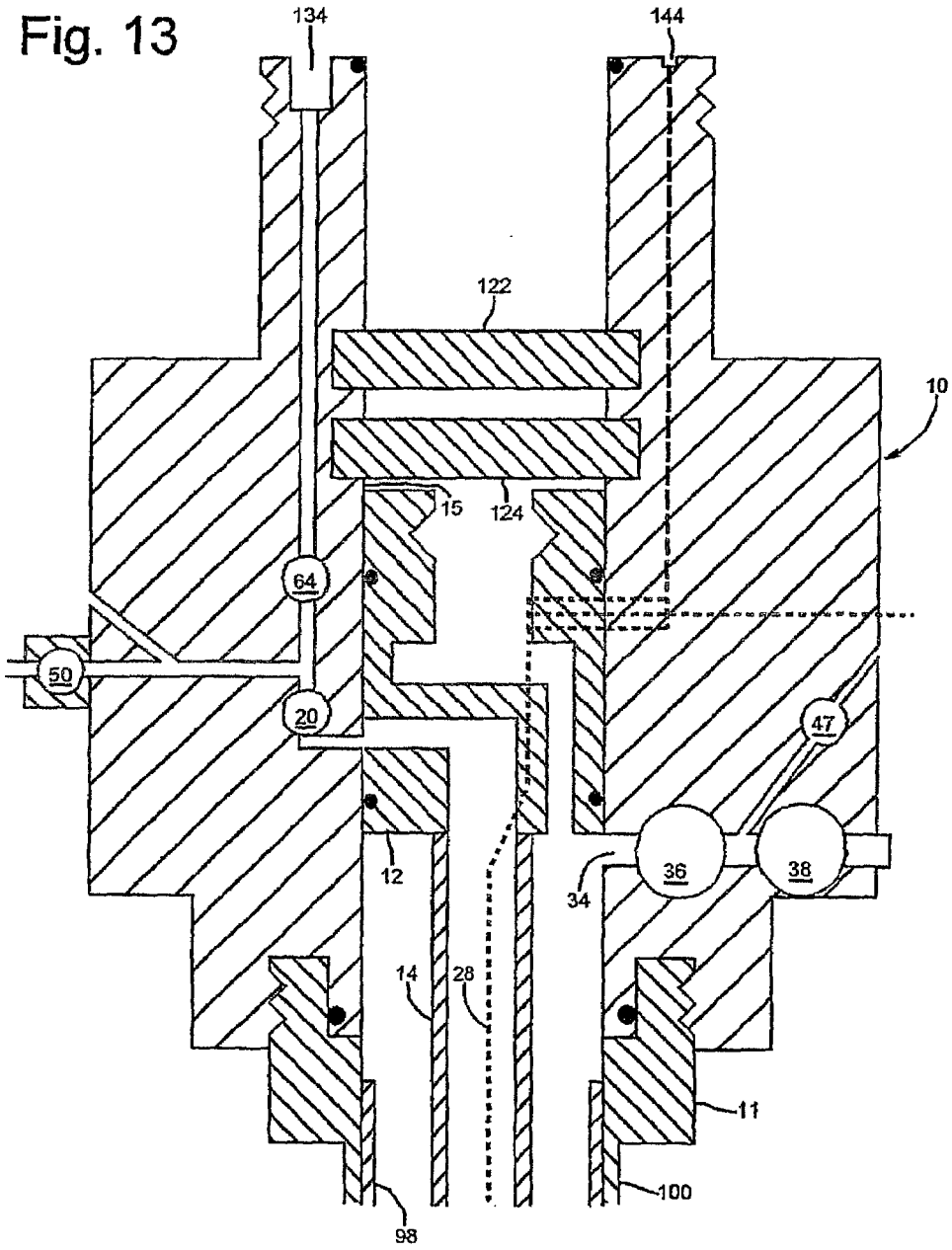

FIG. 12 shows a modification of the FIG. 10 embodiment, for which the installation process is similar to a conventional christmas tree, in that a BOP stack is not used on the tree. The BOP stack and marine riser are removed from the wellhead 10 prior to tree installation and a lower riser package 128, emergency disconnect package 130 and an open water riser 132 are used for the coiled tubing hanger installation and flow test. A sealed connection interface 134 is provided for coupling the workover conduit 62 in the tree 10 to a port 136 in the lower riser package 128, of equivalent function to a conventional lower riser package annulus port. An installation test tool is not required for installing and flow testing the completion. The lower riser package128/emergency disconnect package 130 system may have a controls umbilical 142, for example connectable to the tree 10 via remote wet mate couplers 144, for hook up to the tree valves and to the downhole service lines 28 via the horizontal penetrators 126. Installation and recovery of the coiled tubing string may be carried out from a lightweight intervention vessel, without the use of a BOP. The lower riser package includes upper and lower valves 138, 140 (for example large bore gate valves) at least one of which may, if required in an emergency, be used to shear the coiled tubing string. FIG. 13 shows the tree in production mode with the EDP/LRP and riser removed and the swab valves 122, 124 closed above the coiled tubing hanger 12.

Finally, FIG. 14 corresponds to FIG. 13 but shows a modification in which the production conduit 34 intersects with the tree through bore above the coiled tubing hanger 12, rather than below it.

Table 1 sets out barrier matrices for the completions described above, for various procedures and conditions.

| Abbreviations | |
|---|---|
| BOP | Blowout preventer |
| CSV | Circulation/service valve |
| CT | Coiled tubing |
| CTH | Coiled tubing hanger |
| CXT | Conventional tree |
| HXT | Horizontal tree |
| ITC | Internal tree cap |
| ITT | Installation test tool |

-continued

| Abbreviations | |
|---|---|
| LRP | Lower riser package |
| LSV | Lower swab valve |
| LTIV | Liner top isolation valve |
| PBV | Production bypass valve |
| PMV | Production master valve |
| PWV | Production wing valve |
| SSTT | Subsea test tree |
| TH | Tubing hanger |
| USV | Upper swab valve |
| ITC | Internal tree cap |
| WOV | Workover valve |

TABLE 1

(follows)

Figure 9:
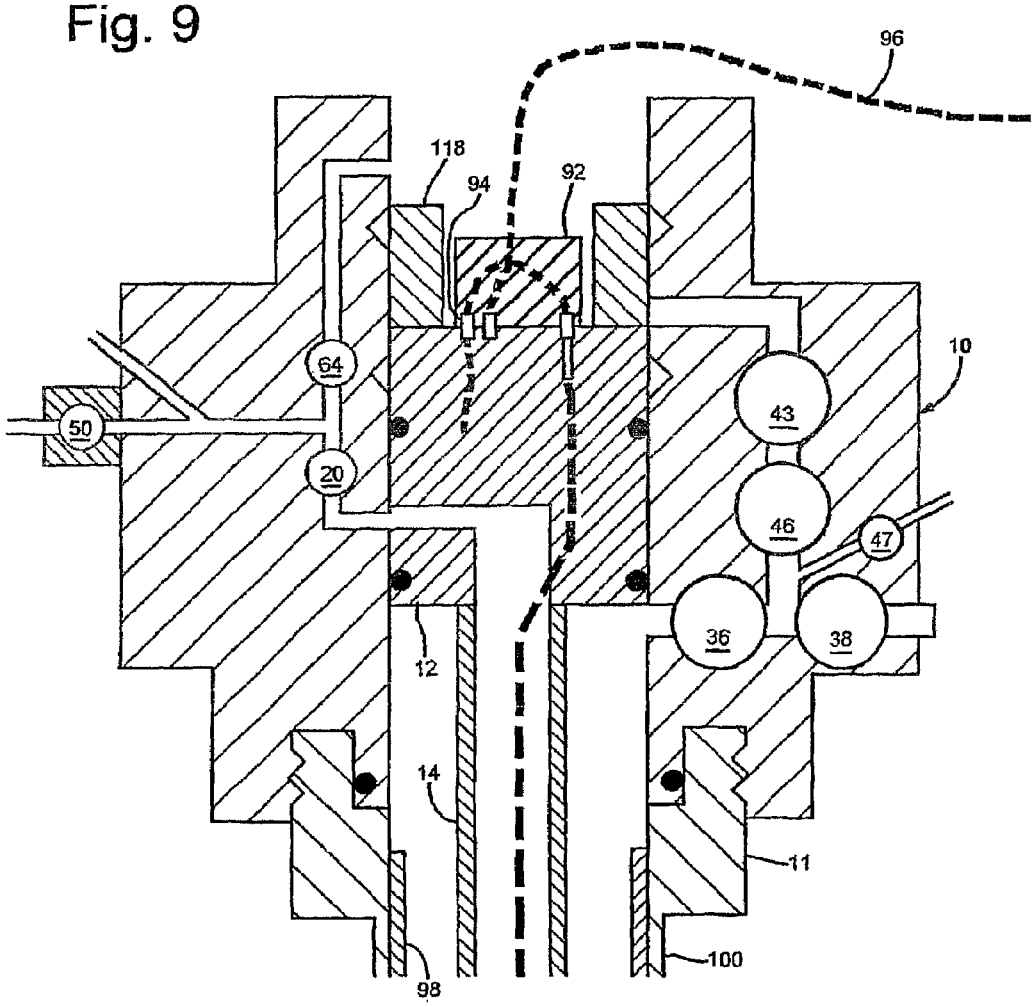
Figure 11:
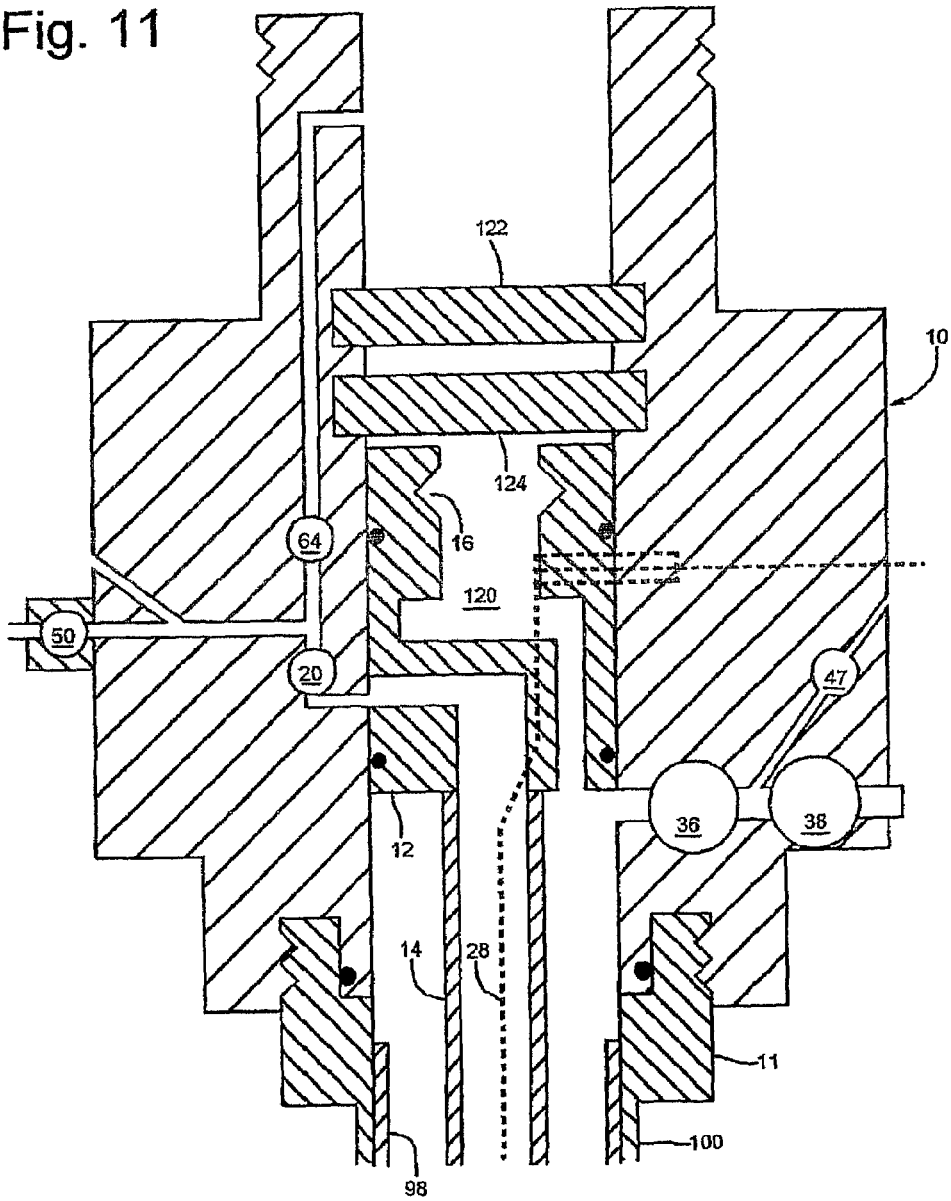

| | COMPLETION TYPE | | | | | | | |
|---|---|---|---|---|---|---|---|---|
| | FIGS. 1 and 2 | | FIGS. 6 and 7 | | FIGS. 8 and 9 | | FIGS. 10 and 11 | |
| PROCEDURE | 1st Barrier | 2nd Barrier | 1st Barrier | 2nd Barrier | 1st Barrier | 2nd Barrier | 1st Barrier | 2nd Barrier |
| Foundation | | | | | | | | |
| Drill 36" hole | N/A | N/A | N/A | N/A | N/A | N/A | N/A | N/A |
| Run and cement 30" conductor and LP housing | N/A | N/A | N/A | N/A | N/A | N/A | N/A | N/A |
| Drill 12-1/4" hole | N/A | N/A | N/A | N/A | N/A | N/A | N/A | N/A |
| Drilling | | | | | | | N/A | N/A |
| Run and cement 6" casing and wellhead housing | N/A | N/A | N/A | N/A | N/A | N/A | N/A | N/A |
| Run BOP stack and marine riser | N/A | N/A | N/A | N/A | N/A | N/A | N/A | N/A |
| Drill 8" hole | Fluid | BOP | Fluid | BOP | Fluid | BOP | Fluid | BOP |
| Run 6" liner | Fluid | BOP | Fluid | BOP | Fluid | BOP | Fluid | BOP |
| Drill 8" hole | Fluid | BOP | Fluid | BOP | Fluid | BOP | Fluid | BOP |
| Run 6" liner | Fluid | BOP | Fluid | BOP | Fluid | BOP | Fluid | BOP |
| Drill 8" hole | Fluid | BOP | Fluid | BOP | Fluid | BOP | Fluid | BOP |
| Run 6" liner | Fluid | BOP | Fluid | BOP | Fluid | BOP | Fluid | BOP |
| Drill 8" hole | N/A | N/A | N/A | N/A | N/A | N/A | N/A | N/A |
| Run 6" liner and lower completion with LTIV | N/A | N/A | N/A | N/A | N/A | N/A | N/A | N/A |
| Run 5" upper completion and expand onto the 6" liner | N/A | N/A | N/A | N/A | N/A | N/A | N/A | N/A |
| Set casing plugs | Caing plug | Fluid | Casing plug | Fluid | Casing plug | Fluid | Casing plug | Fluid |
| Tree Installation | | | | | | | | |
| Retrieve BOP | Caing plug | Fluid | Casing plug | Fluid | Casing plug | Fluid | Casing plug | Fluid |
| Run HXT | Caing plug | Fluid | Casing plug | Fluid | Casing plug | Fluid | Casing plug | Fluid |
| Run BOP/LRP | Caing plug | Fluid | Casing plug | Fluid | Casing plug | Fluid | Casing plug | Fluid |
| Completion | | | | | | | | |
| Drill out/remove casing plugs | N/A | N/A | N/A | N/A | N/A | N/A | N/A | N/A |
| Drill 8" hole | Fluid | BOP | Fluid | BOP | Fluid | BOP | Fluid | BOP |
| Run 6" liner and lower completion with LTIV | Fluid | BOP | Fluid | BOP | Fluid | BOP | Fluid | BOP |
| Pull HXT bore protector | LTIV | Fluid/BOP | LTIV | Fluid/BOP | LTIV | Fluid/BOP | LTIV | Fluid/BOP |
| Run 5" upper completion (outer tubing) and expand onto the 6" liner | LTIV | Fluid/BOP | LTIV | Fluid/BOP | LTIV | Fluid/BOP | LTIV | Fluid/BOP |
| Run CTH, lock and test | LTIV | Fluid/BOP/ CTH | LTIV | Fluid/BOP/ CTH | LTIV | Fluid/BOP/ CTH | LTIV | Fluid/BOP CTH |
| Flow Test | | | | | | | | |
| Circulate to lighter fluid | LTIV | CSV | LTIV | CSV | LTIV | CSV | LTIV | CSV |
| Overpressure the LTIV and flow test the well | PWV CSV ITT | Pressure Cap WOV BOP | PWV CSV ITT | Pressure cap WOV BOP | PWV CSV ITT | Pressure Cap WOV BOP | PMV CSV ITT | PWV WOV BOP |
| Isolate well at HXT | PMV | PWV | PMV | PBV | PMV | PBV | USV | LSV |
| Run ITC | CTH | ITC and | CTH | ITC and | N/A | N/A | N/A | N/A |

TABLE 1-continued (follows)

| | | | | | | | | |
|---|---|---|---|---|---|---|---|---|
| | | BOP | | BOP | | | | |
| Run CTH 2ary lockdown | N/A | N/A | N/A | N/A | CTH | BOP | N/A | N/A |
| Pull BOP/LRP | CTH | ITC | CTH | ITC | CTH upper seal | CTH lower seal | USV | LSV |
| Install controls cap by ROV | CTH | ITC | CTH | ITC | CTH upper seal | CTH lower seal | N/A | N/A |
| Produce to flow lines | CTH | ITC | CTH | ITC | CTH upper seal | CTH lower seal | USV | LSV |
| Tubing access workover with BOP | | | | | | | | |
| Pull controls cap | CSV | ITC | CTH | ITC | CTH upper seal | CTH lower seal | N/A | N/A |
| Pull ITC | CSV | BOP | CTH | BOP | CTH | BOP | N/A | N/A |
| Run LRP/ BOP + marine riser | N/A | N/A | N/A | N/A | N/A | N/A | USV | LSV |
| Run ITT | CSV | BOP | CTH | BOP | CTH | BOP | USV | LSV |
| Circulate the well to kill weight | Fluid | CSV + BOP | Fluid | CTH + BOP | Fluid | CTH + BOP | Fluid | BOP |
| Pull CTH | Fluid | BOP | Fluid | BOP | Fluid | BOP | Fluid | BOP |
| Replace CTH | Fluid | BOP | Fluid | BOP | Fluid | BOP | Fluid | BOP |
| Circulate the well to light weight | CSV | CSV + BOP | CTH | CSV + BOP | CTH | BOP | USV | LSV |
| Pull ITT | CSV | CSV + BOP | CTH | CSV + BOP | CTH | BOP | USV | LSV |
| Run ITC | CSV | ITC | CTH | ITC | CTH | BOP | N/A | N/A |
| Pull BOP stack + marine riser/LRP | CSV | ITC | CTH | ITC | CTH upper seal | CTH lower seal | USV | LSV |
| Install controls cap | CSV | ITC | CTH | ITC | CTH upper seal | CTH lower seal | N/A | N/A |
| Tubing access workover with LWI Vessel | | | | | | | | |
| Similar to above | | | | | | | | |
| Outer tubing retrieval workover with BOP | | | | | | | | |
| Assumed to be impossible due to tubing being expanded onto previous casing | | | | | | | | |

Figure 14:
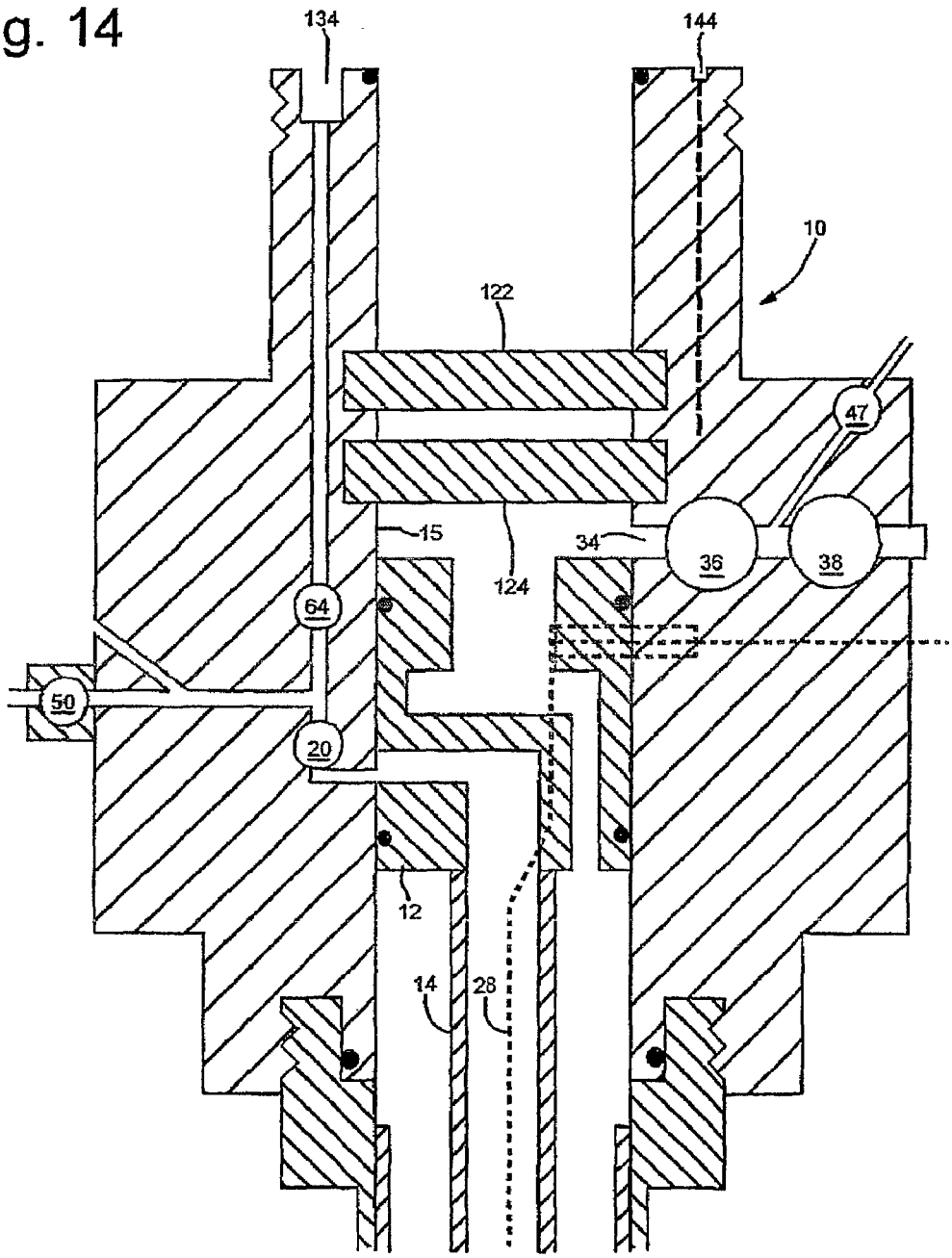
FIG. 14 shows a modification of the embodiment of FIG. 13.
Figure 15:
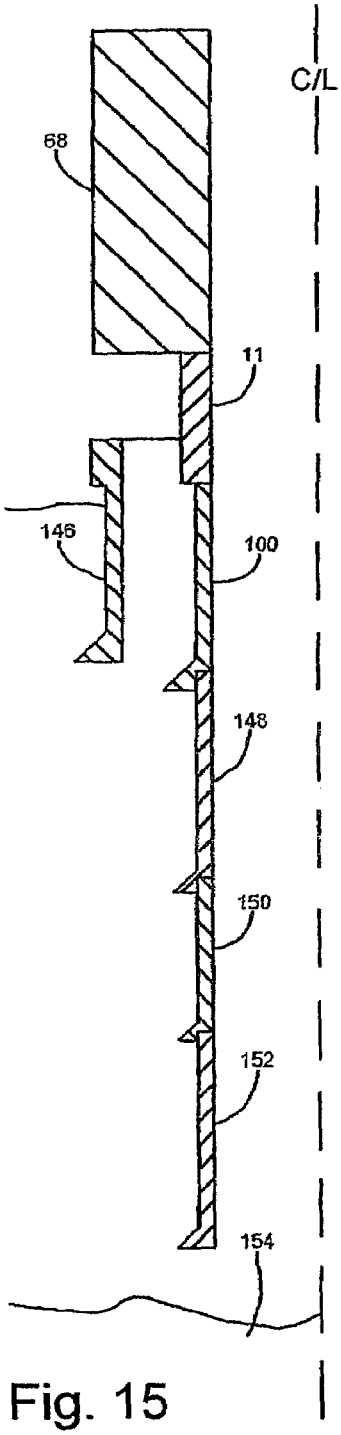
FIG. 15 is a diagram of a first casing program that may be used in conjunction with the completion system of the invention.

| | COMPLETION TYPE FIGS. 12, 13 and 14 | | |
|---|---|---|---|
| PROCEDURE | 1st Barrier | 2nd Barrier | COMMENTS |
| Foundation | | | |
| Drill 36" hole | N/A | N/A | |
| Run and cement 30" conductor and LP housing | N/A | N/A | Assuming that well foundation is needed as per FIG. 15 |
| Drill 12-1/4" hole | N/A | N/A | |
| Drilling | | | |
| Run and cement 6" casing and wellhead housing | N/A | N/A | HP housing has 6–8½" nom. bore and no casing hanger landing shoulder.H-4 profile per 18¾" system to allow wide range of BOP stacks. |
| Run BOP stack and marine riser | N/A | N/A | 18¾" system or smaller 6" minimum ID |
| Drill 8" hole | Fluid | BOP | |
| Run 6" liner | Fluid | BOP | |
| Drill 8" hole | Fluid | BOP | |
| Run 6" liner | Fluid | BOP | |
| Drill 8" hole | Fluid | BOP | |
| Run 6" liner | Fluid | BOP | |
| Drill 8" hole | Fluid | BOP | |
| Run 6" liner and lower completion with LTIV | Fluid | BOP | |
| Run 5" upper completion and expand onto the 6" liner | LTIV | Fluid/BOP | |
| Set casing plugs | Casing plug | Fluid | |
| Tree Installation | | | Alternatively, install the tree at the same time as the WH housing and drill thru tree. |
| Retrieve BOP | Casing plug | Fluid | |
| Run HXT | Casing plug | Fluid | |
| Run BOP/LRP | Casing plug | Fluid | LRP used in FIGS. 12–14 |
| Completion | | | |
| Drill out/remove casing plugs | Fluid | LRP | |
| Drill 8" hole | N/A | N/A | Drill into formation |

TABLE 1-continued (follows)

| | | | |
|---|---|---|---|
| Run 6" liner and lower completion with LTIV | N/A | N/A | Assumes LTIV That can be opened by overpressure or cyclic pressure |
| Pull HXT bore protector | N/A | N/A | |
| Run 5" upper completion (outer tubing) and expand onto the 6" liner | N/A | N/A | Assumes that no packer is used |
| Run CTH, lock and test | LTIV | Fluid/LRP/ CTH | Assumes no SSTT needed. CTH run on CT installation string, FIGS. 1, 6, 8 |
| Flow Test | | | |
| Circulate to lighter fluid | LTIV | CSV | Open CSV. Close when complete |
| Overpressure the LTIV and flow test the well | PMV<br>CSV<br>USV | PWV<br>WOV<br>LSV | Flow test via PBV and ITT, FIGS. 1–11. Disconnect/drive off by closing HXT values => no SSTT needed |
| Isolate well at HXT | USV | LSV | Close PMV and PBV |
| Run ITC | N/A | N/A | |
| Run CTH 2ary lockdown | N/A | N/A | Maybe unnecessary |
| Pull BOP/LRP | USV | LSV | Assumed acceptable as seals independently testable and on different seal bores. LRP use for FIGS. 12–14 |
| Install controls cap by ROV | N/A | N/A | |
| Produce to flow lines | USV | LSV | Open PMV and PWV |
| Tubing access workover with BOP | | | |
| Pull controls cap | N/A | N/A | |
| Pull ITC | N/A | N/A | |
| Run LRP/ BOP + marine riser | USV | LSV | BOP FIGS. 10, 11 18¾" or smaller. 9" min. ID. LRP FIGS. 12–14 |
| Run ITT | N/A | N/A | |
| Circulate the well to kill weight | Fluid | LRP | Open CSV. Close BOP rams on the ITT and circulate via choke/kill, FIGS. 1–11 |
| Pull CTH | Fluid | LRP | Open USV, LSV, FIGS. 10–14 |
| Replace CTH | Fluid | LRP | |
| Circulate the well to light weight | USV | LSV | |
| Pull ITT | N/A | N/A | |
| Run ITC | N/A | N/A | |
| Pull BOP slack + marine riser/LRP | USV | LSV | |
| Install controls cap | N/A | N/A | |
| Tubing access workover with LWI Vessel | | | |
| Similar to above | | | |
| Outer tubing retrieval workover with BOP | | | |
| Assumed to be impossible due to tubing being expanded onto previous casing | | | |

Figure 16:
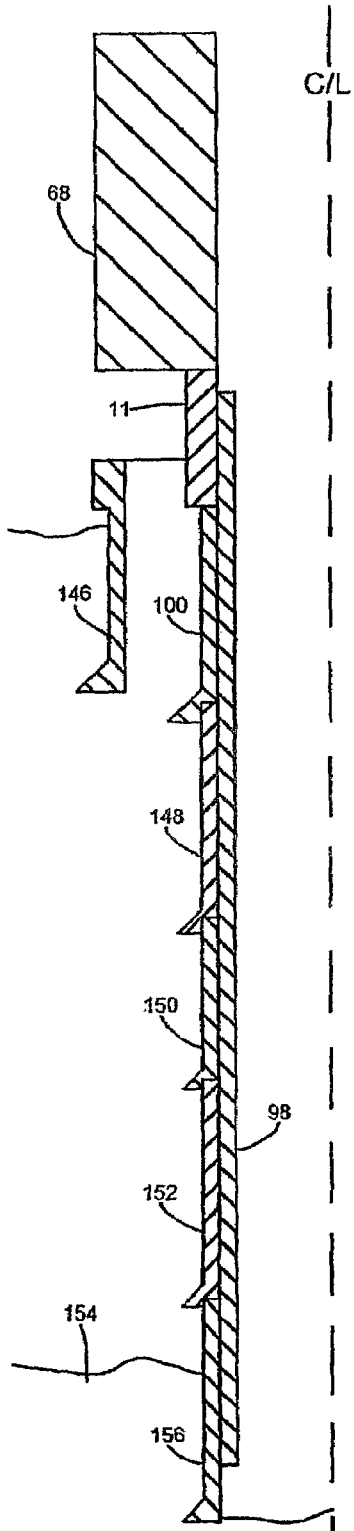
FIG. 16 corresponds to FIG. 15 but diagrammatically indicates a liner, an outer tubing string and completion riser run into the casing.
Figure 17:
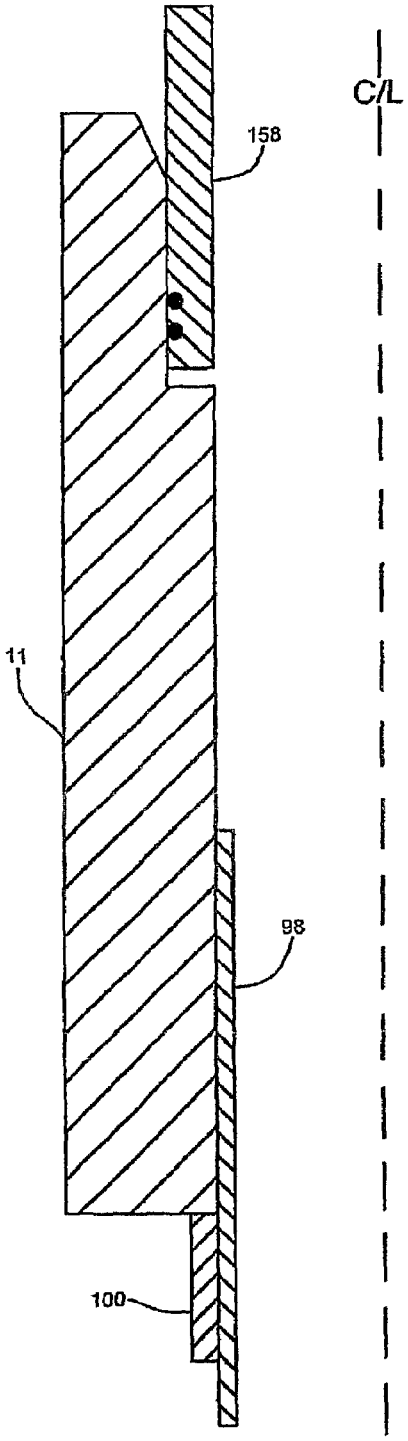
FIG. 17 is a diagram of the interface between the tree, wellhead housing and outer tubing hanger of the completion system of FIG. 16.
Figure 18:
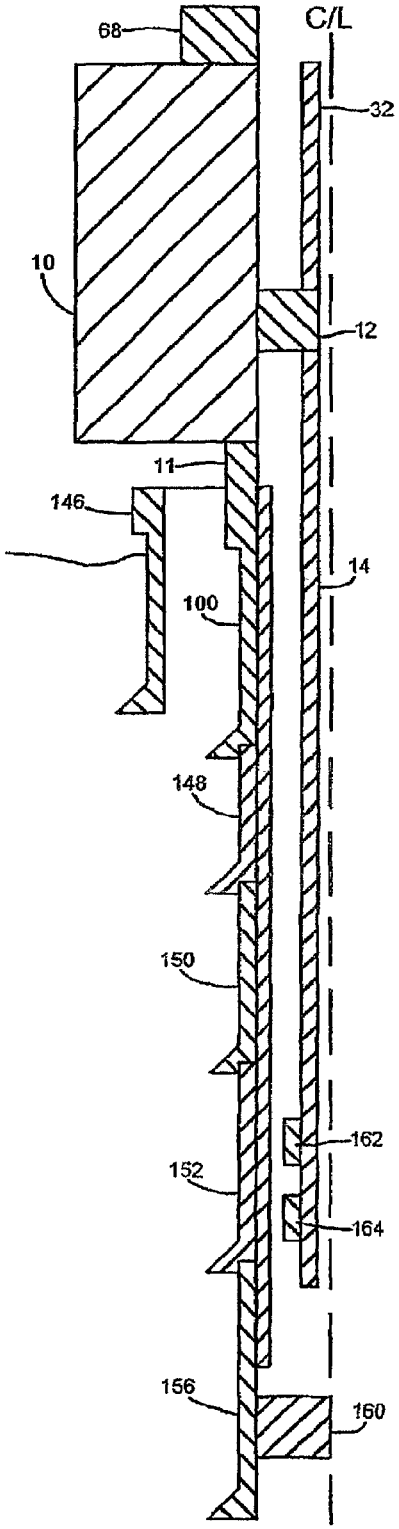
FIG. 18 corresponds to FIG. 17 but diagrammatically indicates a central circulation tubing string and liner top isolation valve installed in the well.

FIGS. 15–18 are highly schematic half-sectional representations of a casing program that may be used with the wellhead housing 11 of the previous figures. FIGS. 15 and 16 are prior to tree installation; and FIG. 18 shows the tree 10 installed. Initially, a foundation is established using conductor casing 146, for example a 13⅜" conductor or larger. The size of the LP housing and foundation is substantially independent of the size of the rest of the system.

A hole section is then drilled, a first casing section 100 is run and cemented and the wellhead housing 11 established. This may be of small diameter (21.6 mm, 8½" drift). A further hole section is then drilled and an expandable casing section 148 run, cemented and expanded to the bore diameter of the first casing section 100. Expansion seals the casing section to the previously installed casing without the use of packers or the like. Methods for installing expandable tubulars are known in the art and will not be further elaborated here. The expansion pig may be run either from the top down or from the bottom up. However, the bottom up method is preferred, as then no hangers are needed.

Drilling continues and as many further casing sections 150, 152 as may be needed to reach the reservoir 154 are installed successively. All casing sections are expanded to the bore diameter of the initial section 100 (e.g. 6"), to produce a parallel sided well. When needed, the BOP 68 is installed on the wellhead housing 11. All casing sections are capable of withstanding the reservoir pressure.

Drilling is continued into the reservoir 154 as shown in FIG. 16 and a liner section 156 is installed and expanded to the casing diameter. The outer tubing string 98 is then run and expanded (preferably using the bottom up method) into sealing contact with the liner 156, casing and wellhead 11. Therefore no tubing hanger or packers are needed to support the tubing 98 and seal it in the wellhead housing 11: see FIG.

17. Also, the final top location of the tubing is not accurately predictable due to axial shrinkage during radial expansion. The liner 156 is perforated and a liner top isolation valve 160 or similar isolation device installed. Also shown in FIG. 17 is a tree stab 158 for sealing the tree 10 to a corresponding pocket in the wellhead housing 11.

Figure 19:
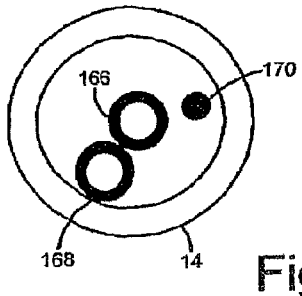
FIG. 19 is a diagrammatic cross-section through the central circulation tubing.

FIG. 18 shows the tree 10 attached to the wellhead housing 11 in place of the BOP and the BOP reinstalled on the tree. The coiled tubing string 14 and coiled tubing hanger 12 is then run on the installation string 32 and landed in the tree 10. The coiled tubing string 14 may be used to carry downhole instrumentation, chemical injection and gas lift mandrels 162, 164, ESP's, separation equipment and the like, as discussed above, as well as any required service lines. These may be secured to the coiled tubing exterior as shown in FIGS. 3 and 4. Preferably however they are enclosed within the coiled tubing bore as indicated in FIGS. 1, 2 and 5–14. FIG. 19 is a diagrammatic cross-section through the coiled tubing, showing two fluid containing service lines 166, 168 and an electrical or optical service line 170.

Figure 20:
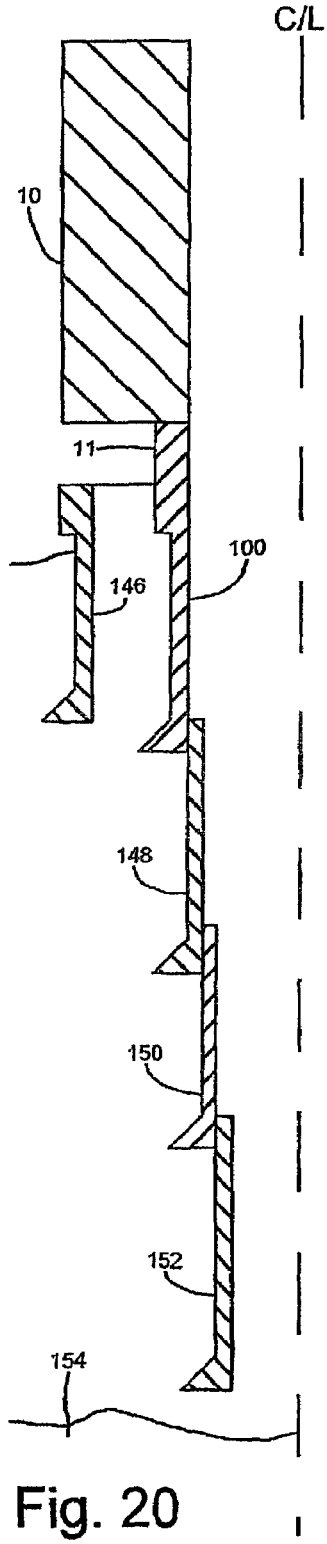
FIG. 20 is a diagram of a second casing program that may be used in conjunction with the completion system of the invention.

FIGS. 20–22 show an alternative casing program. Again no casing hangers are required at the wellhead housing 11 and each casing section is capable of withstanding the reservoir pressure. The casing sections are each expanded into seating contact with the previously installed section, but are of successively smaller diameters. For example a 30" conductor casing 146 may be used, with the other casing diameters (when expanded) as follows:

100: 9⅝"; 148: 8⅝"; 150: 7⅝"; 152: 6⅝"

Referring to FIG. 21, the final well section is drilled into the reservoir 154 and a (for example) 5⅝" liner 156 and liner top isolation valve are 160 installed. The liner is expanded into sealing contact with the lowermost casing section 152.

As shown in FIG. 21, the outer tubing string 98 is run on a completion riser 174 and expanded at its lower end onto the production liner 156. The tubing string 98 is suspended from an outer tubing hanger 172 landed, sealed and locked down in the wellhead housing 11. No production packer is needed.

There are several possible methods of setting the outer tubing hanger 172 and facilitating the expansion of the outer tubing 98 onto the liner 156. The preferred methods are based on the "top down" expansion principle. This is better for this particular well construction due to the tapering casing strings. The outer tubing 98 only eliminates the tubing/production casing annulus at the lower section. A "bottom up" approach is only readily usable if a correspondingly tapered outer tubing 98 is used. This is inconvenient due the number of trips required to set the different sizes of pig and the increased tubing costs at the top sections.

FIG. 22 shows a first setting method. The outer tubing hanger 172 is run on a tool 174 and drill pipe 176. The expansion pig 178 is attached to coiled tubing 180. The pig 178 is pumped down by pressurised fluid supplied through the drill pipe/coiled tubing annulus. The coiled tubing 180 provides a return path up the tool string. However there may be difficulties in running coiled tubing at the same time as drill pipe.

A preferred alternative is as shown in FIG. 23. The bores of the THRT 174 and of the running string 176 are made large enough to drift the pig 178. The pig is easier to install as the coiled tubing 180 can be run after the tubing hanger 172 has landed. The coiled tubing annulus again provides the pressurised fluid flow path for expansion of the outer tubing 98, and the coiled tubing bore the return path.

There are various options for the seal interface between the wellhead housing 11 and the tree 10. One consideration is the need to isolate the VX gasket from the produced fluids. FIG. 24 shows a wellhead/tree seal arrangement for a completion including an outer tubing hanger 172. A seal pocket is provided at the upper internal diameter of the wellhead housing to interface a seal stab 158 on the tree. This corresponds somewhat to the FIG. 17 arrangement. The tree seal stab 158 has a drift diameter that allows passage of the tubing hanger to the bore of the well. This arguably is a single barrier to the environment if the VX gasket is discounted.

Figure 25:
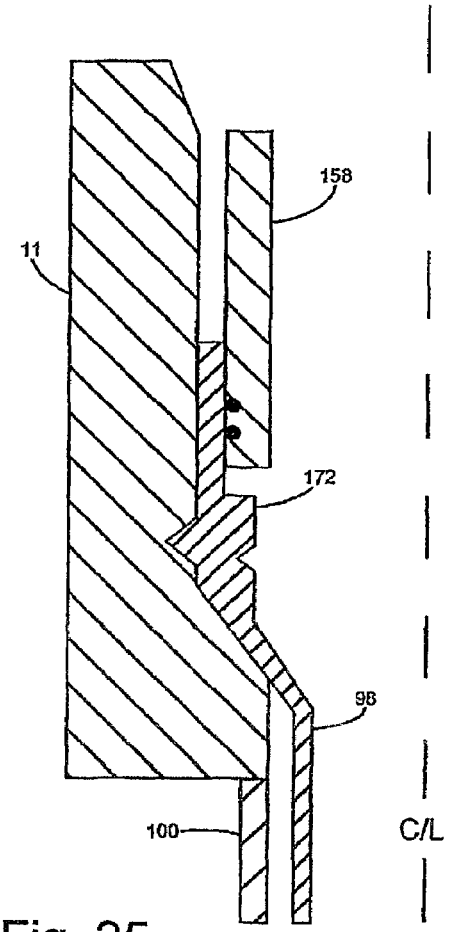
FIGS. 25 to 27 show modifications of FIG. 24.

Alternatively, a seal pocket may be provided at the upper inside diameter of the outer tubing hanger 172 to interface a seal stab 158 on the tree, as shown in FIG. 25. With this option, the outer tubing 98 must be installed prior to tree installation. However the arrangement is arguably closer to that found in a conventional christmas tree and may therefore more readily gain industry acceptance and/or regulatory approval.

Figure 26:
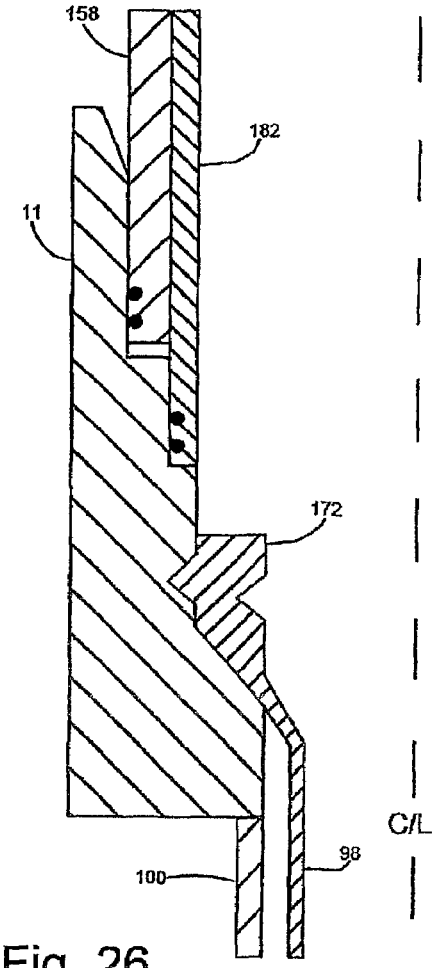
Figure 27:
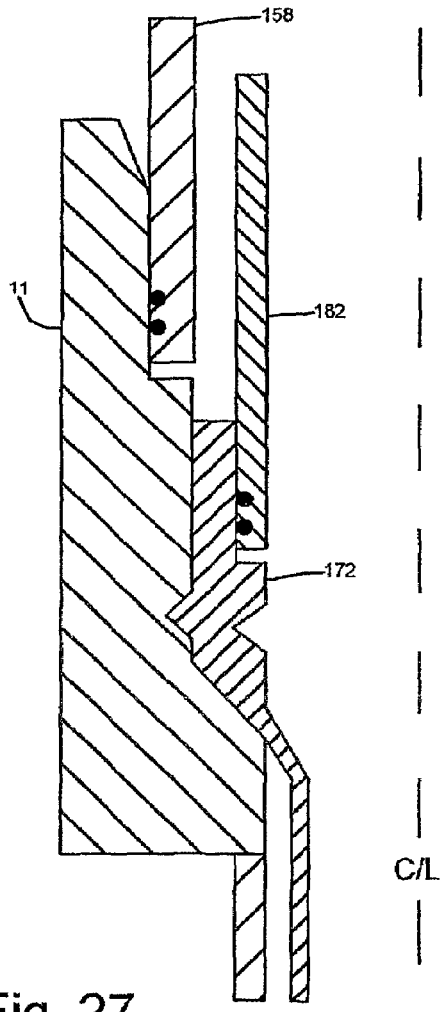

The arrangement shown in FIG. 26 is similar to that shown in FIG. 24, but includes a further seal pocket at the wellhead housing 11 inside diameter, to interface a further seal stab 182 from the coiled tubing hanger 12 or another component to be located in the bore 15 of the tree 10. The arrangement shown in FIG. 17 may be modified likewise, so that the wellhead housing 11 accommodates a further seal stab e.g. from the coiled tubing hanger 12. FIG. 27 is similar to FIG. 26, except that the pocket for the further seal stab 182 is at the outer tubing hanger 172 upper inside diameter.

Figure 28:
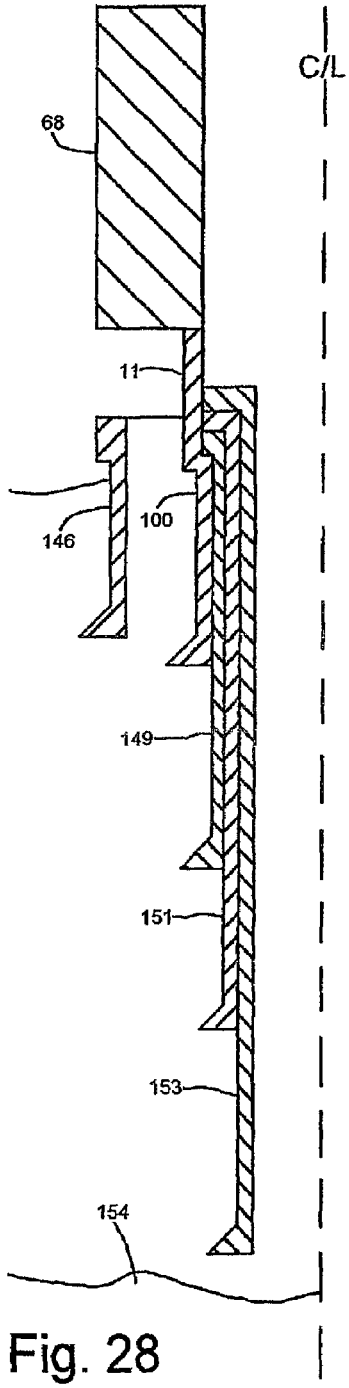
FIG. 28 is a diagram of a third casing program that may be used in conjunction with the completion system of the invention.

FIGS. 28–30 are diagrams of a third drilling program. Casing hangers are used in the wellhead housing 11 to suspend concentric casing strings 149, 151, 153 and production casing 157. Each string is successively landed and expanded into sealing contact with the next outer string, preferably using a top down method such as shown in FIGS. 22 or 23. Prior to expansion, a temporary annulus exists between a given casing string and the next outer casing string. This can be used for circulation/cementing. Packoffs are not needed due to the seal effected between the concentric strings. The expanded casing sizes may be as follows:

100: 9⅝"; 149: 7½"; 151: 7"; 153: 6½"; 157: 6"

As shown in FIG. 29, outer tubing 98 is suspended in the wellhead 11 from tubing hanger 172. The tubing 98 is then expanded onto the production liner 157. Again the production liner has an isolation device such as a liner top isolation valve. No packer is needed and the tubing hanger 172 need not itself be sealed and locked to the wellhead housing 11. (The expanded outer tubing 98 is sealed to the production casing 157).

FIG. 30 is a diagram showing the outer string hanger 172 and casing hangers 186, 188, 190, 192 for the successive casing strings 149, 151, 153, 157, landed in the (consequently elongated) wellhead housing 11. An interface with the tree seal stab 158 is also shown. Modification is of course possible in accordance with any of FIGS. 25–27.

The invention claimed is:

1. A completion system comprising:

a wellhead housing which is mounted on a casing string that is installed in a well;

a christmas tree which is mounted on the wellhead housing;

a tubing hanger which is landed and sealed in a vertically extending through bore in the tree;

a first tubing string which is suspended from the tubing hanger within the casing string; and a second tubing string which is expanded into sealing engagement with the casing string over at least a portion of their lengths;

wherein the annulus defined between the first and second tubing strings serves as a production bore for conveying produced fluids out of the well and the first tubing string serves as a well service conduit;

wherein the tree comprises a production conduit which communicates with the production bore below the tubing hanger seal and a service/circulation conduit which communicates with the first tubing string; and wherein fluids may be communicated between the first tubing string and the service/circulation conduit independent of any crossover conduit that may be connected to the production conduit.

2. A completion system as defined in claim 1, characterised in that the entire length of the second tubing string is expanded into contact with the casing string.

3. A completion system as defined in claim 2, characterised in that the second tubing string is supported without the use of a tubing hanger and/or packers.

4. A completion system as defined in claim 1, characterised in that the second tubing string is suspended from a hanger supported in the wellhead housing.

5. A completion system as defined in claim 1, characterised in that said annulus is connected to at least one production flow control valve in the tree.

6. A completion system as defined in claim 1, characterised in that the first tubing string is connected to at least one flow control valve.

7. A completion system as defined in claim 1, characterised in that the first tubing string comprises coiled tubing.

8. A completion system as defined in claim 1, further comprising a production master valve and a production wing valve in the production conduit.

9. A completion system as defined in claim 1, characterised in that the tree comprises a production bypass conduit extending between the production conduit and a portion of the through bore which is located above the tubing hanger seal.

10. A completion system as defined in claim 9, characterised in that at least one of the production bypass conduit and the portion of the through bore above the tubing hanger seal is closeable by at least one removable barrier element.

11. A completion system as defined in claim 10, characterised in that the at least one removable barrier element comprises a swab valve.

12. A completion system as defined in claim 9, characterised in that an installation test tool is connectable between the tubing hanger and an installation string and comprises a conduit communicating between the production bypass conduit and a riser conduit in the installation string.

13. A completion system as defined in claim 12, characterised in that, in production mode, the production bypass conduit is sealed by an internal tree cap installed in the through bore.

14. A completion system as defined in claim 9, further comprising at least two flow control valves which are positioned in the bypass conduit.

15. A completion system as defined in claim 1, characterised in that the tree comprises a workover conduit which extends from the service/circulation conduit to a port in the through bore above the tubing hanger.

16. A completion system as defined in claim 15, characterised in that the workover conduit contains a workover valve.

17. A completion system as defined in claim 1, characterised in that the tree comprises a workover conduit which extends from the service/circulation conduit upwardly through the tree to a lower riser package.

18. A completion system as defined in claim 1, characterised in that the tree comprises a crossover conduit which extends between the production conduit and the service/circulation conduit.

19. A completion system as defined in claim 18, characterised in that the crossover conduit contains a crossover valve.

20. A completion system as defined in claim 1, characterised in that an upper end of the tubing hanger comprises at least one remote matable coupler part for connecting a downhole service line to a corresponding coupler part in a tree cap or installation test tool.

21. A completion system as defined in claim 1, characterised in that the tubing hanger interfaces with a horizontal penetrator provided in the tree for making an external connection to a number of downhole service lines.

22. A completion system as defined in claim 1, characterised in that an annular stab connector extends from the tree and is received in the wellhead housing or in a hanger which is received in the wellhead housing.

23. A completion system as defined in claim 1, characterised in that an annular stab connector extends from the tubing hanger and is received in the wellhead housing or in a hanger which is received in the wellhead housing.

24. A completion system as defined in claim 1, wherein the tubing hanger comprises a flow by conduit which extends between the annulus and a portion of the through bore that is located above the tubing hanger seal.

25. A completion system comprising:

a wellhead housing which is mounted on a casing string that is installed in a well;

a christmas tree which is mounted on the wellhead housing;

a tubing hanger which is landed and sealed in a vertically extending through bore in the tree;

a first tubing string which is suspended from the tubing hanger within the casing string; and a second tubing string which is expanded into sealing engagement with the casing string over at least a portion of their lengths;

wherein the annulus defined between the first and second tubing strings serves as a production bore for conveying produced fluids out of the well and the first tubing string serves as a well service conduit;

wherein the tree comprises a production conduit which intersects the through bore below the tubing hanger seal and a service/circulation conduit which intersects the through bore and communicates with the first tubing string; and wherein the tubing hanger comprises a side outlet which communicates with both the first tubing string and the service/circulation conduit when the tubing hanger is landed in the tree so as to define a service/circulation flow path extending from an upper end of the first tubing string and through the tree.

26. A completion system as defined in claim 25, characterised in that the service/circulation flow path includes a central service/circulation valve.

27. A completion system as defined in claim 26, characterised in that the service/circulation flow path includes a service/circulation wing valve.

28. A completion system comprising:

a wellhead housing which is mounted on a casing string that is installed in a well;

a christmas tree which is mounted on the wellhead housing;

a tubing hanger which is landed and sealed in a vertically extending through bore in the tree;

a first tubing string which is suspended from the tubing hanger within the casing string; and a second tubing string which is expanded into sealing engagement with the casing string over at least a portion of their lengths;

wherein the annulus defined between the first and second tubing strings serves as a production bore for conveying produced fluids out of the well and the first tubing string serves as a well service conduit;

wherein the tree comprises a production conduit which intersects the through bore below the tubing hanger seal and a service/circulation conduit which intersects the through bore and communicates with the first tubing string; and an installation test tool which is connectable to the tubing hanger and which comprises a side outlet that communicates with both the first tubing string and the service/circulation conduit when the tubing hanger is landed in the tree so as to define a service/circulation flow path extending from the upper end of the first tubing string and through the tree.

29. A completion system as defined in claim 28, characterised in that, in production mode, the installation test tool is replaced by an internal tree cap comprising a side outlet in communication with the first tubing string and the service/circulation conduit, so as to define said service/circulation flow path.

30. A completion system comprising:

a wellhead housing which is mounted on a casing string that is installed in a well;

a christmas tree which is mounted on the wellhead housing;

a tubing hanger which is landed and sealed in a vertically extending through bore in the tree;

a first tubing string which is suspended from the tubing hanger within the casing string;

a second tubing string which is expanded into sealing engagement with the casing string over at least a portion of their lengths;

wherein the annulus defined between the first and second tubing strings serves as a production bore for conveying produced fluids out of the well and the first tubing string serves as a well service conduit;

wherein the tree comprises a production conduit which intersects the through bore below the tubing hanger seal, a service/circulation conduit which intersects the through bore and communicates with the first tubing string, and a workover conduit which extends from the service/circulation conduit to a port in the through bore above the tubing hanger; and an installation test tool which is connectable to the tubing hanger and which comprises a lower end that is sealable within the through bore below the port and an upwardly extending spool that is engageable by a pair of pipe rams of a BOP to provide communication between the workover conduit and a choke or kill line of the BOP.

31. A completion system comprising:

a wellhead which is mounted on a casing string that is installed in a well;

a christmas tree which is mounted on the wellhead housing;

a tubing hanger which is landed in the tree;

a first tubing string which is suspended from the tubing hanger within the casing string and is connected to a service/circulation conduit in the tree; and a second tubing string which is expanded into sealing engagement with the casing string over at least a portion of their lengths;

wherein the annulus defined between the first and second tubing strings serves as a production bore for conveying produced fluids out of the well and the first tubing string serves as a well service conduit;

wherein an upper end of the tubing hanger comprises at least one remote matable coupler part for connecting a downhole service line to a corresponding coupler part in a tree cap or installation test tool; and wherein the tubing hanger comprises separable upper and lower parts, wherein downhole service lines are pre-assembled to coupler parts provided in the lower tubing hanger part, and wherein co-operating coupler parts are provided in the upper tubing hanger part.

* * * * *